US008604994B2

(12) United States Patent
Shinkai et al.

(10) Patent No.: US 8,604,994 B2
(45) Date of Patent: Dec. 10, 2013

(54) ANTENNA APPARATUS INCLUDING FEEDING ELEMENTS AND PARASITIC ELEMENTS ACTIVATED AS REFLECTORS

(75) Inventors: Sotaro Shinkai, Osaka (JP); Wataru Noguchi, Hyogo (JP); Hiroyuki Yurugi, Osaka (JP); Akihiko Shiotsuki, Osaka (JP); Masahiko Nagoshi, Osaka (JP); Koichiro Tanaka, Hyogo (JP)

(73) Assignee: Panasonic Corporation, Osaka (JP)

( * ) Notice: Subject to any disclaimer, the term of this patent is extended or adjusted under 35 U.S.C. 154(b) by 322 days.

(21) Appl. No.: 13/123,063

(22) PCT Filed: Oct. 7, 2009

(86) PCT No.: PCT/JP2009/005202

§ 371 (c)(1),
(2), (4) Date: Apr. 7, 2011

(87) PCT Pub. No.: WO2010/041436

PCT Pub. Date: Apr. 15, 2010

(65) Prior Publication Data

US 2011/0193761 A1 Aug. 11, 2011

(30) Foreign Application Priority Data

Oct. 7, 2008 (JP) ..... 2008-260376

(51) Int. Cl.
*H01Q 21/00* (2006.01)

(52) U.S. Cl.
USPC ..... 343/817; 343/700 MS

(58) Field of Classification Search
USPC ..... 343/817, 858, 700 MS
See application file for complete search history.

(56) References Cited

U.S. PATENT DOCUMENTS

| | | | | |
|---|---|---|---|---|
| 7,106,270 | B2 | 9/2006 | Iigusa et al. | |
| 7,656,360 | B2 | 2/2010 | Hirabayashi | |
| 2005/0206573 | A1 | 9/2005 | Iigusa et al. | |
| 2007/0001924 | A1 | 1/2007 | Hirabayashi | |
| 2008/0048917 | A1 * | 2/2008 | Achour et al. | 343/700 MS |
| 2008/0129636 | A1 * | 6/2008 | Surittikul et al. | 343/858 |
| 2010/0231451 | A1 | 9/2010 | Noguchi et al. | |

FOREIGN PATENT DOCUMENTS

| | | |
|---|---|---|
| JP | 2002-261532 | 9/2002 |
| JP | 2002-299952 | 10/2002 |
| JP | 2005-244890 | 9/2005 |
| JP | 2005-253043 | 9/2005 |
| JP | 2007-013692 | 1/2007 |

(Continued)

OTHER PUBLICATIONS

International Preliminary Report on Patentability issued May 26, 2011 in International (PCT) Application No. PCT/JP2009/005202, together with English translation thereof.

(Continued)

*Primary Examiner* — Karl D Frech
(74) *Attorney, Agent, or Firm* — Wenderoth, Lind & Ponack, L.L.P.

(57) ABSTRACT

An antenna apparatus includes an antenna element and a parasitic element provided on a first surface of a dielectric substrate, and an antenna element and a parasitic element provided on a second surface of the dielectric substrate. Each of the parasitic elements is provided at a position away from the antenna elements by a distance of one-fourth of an operating wavelength λ in communication.

10 Claims, 17 Drawing Sheets

(56) References Cited

FOREIGN PATENT DOCUMENTS

| | | |
|---|---|---|
| JP | 2008-109214 | 5/2008 |
| JP | 2008-177728 | 7/2008 |
| JP | 2008-211586 | 9/2008 |

OTHER PUBLICATIONS

International Search Report issued Dec. 28, 2009 in International (PCT) Application No. PCT/JP2009/005202.

* cited by examiner

ANTENNA APPARATUS INCLUDING FEEDING ELEMENTS AND PARASITIC ELEMENTS ACTIVATED AS REFLECTORS

TECHNICAL FIELD

The present invention relates to a steerable (variable-directional) antenna apparatus whose main radiation direction can be electrically switched over.

BACKGROUND ART

In recent years, apparatuses to which wireless technology is applied have rapidly come into widespread use. Such wireless technology includes a wireless LAN system complying with the IEEE802.11a/b/g standards, Bluetooth and so on. According to the IEEE802.11a or the IEEE802.11g, a data transmission rate is defined as 54 Mbps, however, research and development for realizing the higher transmission rate have been recently energetically pushed forward.

As one of techniques for realizing speeding-up of a wireless communication system, a MIMO (Multi-Input Multi-Output) communication system attracts increasing attention. According to this technique, improvement in communication rate is achieved by improving transmission capacity by realizing spatially multiplexed transmission paths with a plurality of antenna elements provided on a transmitter side and a plurality of antenna elements provided on a receiver side. This technique is indispensable not only to a wireless LAN but also to a system for mobile communication and a next-generation wireless communication system such as the IEEE802.16e (WiMAX).

In the MIMO communication system, transmitting data is distributed to a plurality of antenna elements of a transmitter, and respective distributed transmitting data are transmitted simultaneously at an identical frequency. Transmitted radio waves reach a plurality of receiving antenna elements via various propagation paths in a space. A receiver estimates a transmission function between the transmitting antenna and the receiving antenna, and executes arithmetic processing to reconstruct the original data. Generally speaking, in a case of a wireless apparatus that employs the MIMO communication system, a plurality of omnidirectional feeding elements, such as dipole antennas and sleeve antennas, are used. In this case, there has been such a problem that transmission quality is lowered because of an increased correlation among the feeding elements unless some contrivance is made so as to satisfactorily increase distances among the feeding elements or to provide polarized waves combinations different from each other by directing the respective feeding elements towards different directions.

As the prior art for solving this problem, it may be considered to use an array antenna apparatus such as a directivity adaptive antenna disclosed in Patent Document 1, for example. The array antenna apparatus of Patent Document 1 has such a configuration that three printed circuit boards are arranged so as to surround a periphery of a half-wave dipole antenna which is installed vertically on a dielectric support substrate. A high-frequency signal is supplied to the half-wave dipole antenna via a balanced feeding cable. In addition, each of the printed circuit boards has a back surface on which two pairs of parasitic elements provided in parallel, where one pair of the parasitic elements includes two printed antenna elements (each of which is a conductor pattern). In each pair of parasitic element, the two printed antenna elements are provided so as to be opposed to each other with a predetermined gap therebetween. Each of the printed antenna elements has an opposed-side end to which a through hole conductor is provided, and the through hole conductor is connected to an electrode terminal on a front side of the printed circuit board. In each of the parasitic elements, a varactor diode is mounted between two electrode terminals. Further, each of the electrode terminals is connected to a pair cable via a high-frequency stopping large resistor, and the pair cable is connected to applied bias voltage terminals DC+ and DC− of a controller that controls a directional pattern of the antenna apparatus. By switching over an applied bias voltage from the controller, reactance value of the varactor diode connected to the parasitic element changes. Therefore, electrical lengths of the parasitic elements are changed relative to the half-wave dipole antenna, and a planar directional pattern of the array antenna apparatus is changed.

It is possible to decrease the distances among the feeding elements by adopting an adaptively directional antenna such as the array antenna apparatus of the Patent Document 1 as an antenna for the MIMO communication, and by setting directivity of each of antennas so as not to cause a correlation among the antennas.

CITATION LIST

Patent Document

Patent Document 1: Japanese Patent Laid-open Publication No. JP 2002-261532 A.

SUMMARY OF INVENTION

Technical Problem

It is possible to decrease the distances among the feeding elements by using the adaptive antenna described in the Patent Document 1 in the MIMO communication. However, if a plurality of the conventional adaptive antennas according to the prior art are installed, it is required to arrange the parasitic elements around the respective feeding elements, and this leads to a very large space. For the purpose of size reduction, it may be considered to provide the feeding element and the parasitic elements on one substrate. However, this leads to such a problem that an electric field strength in a normal direction of the substrate does not change.

It is an object of the present invention to provide a steerable antenna apparatus for MIMO communication, which can solve the above problems, requires a small space for installation, and which can change an electric field strength in a normal direction of a substrate.

Solution to Problem

An antenna apparatus according to the present invention is an antenna apparatus includes a first dielectric substrate having first and second surfaces which are in parallel with each other, a second dielectric substrate having first and second surfaces which are in parallel with each other, a first feeding element provided on at least one of the first and second surfaces of the first dielectric substrate, a first parasitic element provided on at least one of the first and second surfaces of the first dielectric substrate, a second feeding element provided on at least one of the first and second surfaces of the second dielectric substrate, a second parasitic element provided on at least one of the first and second surfaces of the second dielectric substrate, and a controller. The first feeding element transmits and receives a wireless signal, and the second feeding element transmits and receives a wireless signal. The controller means switches over between activation and non-activation of each of the first and second parasitic elements as a reflector. The first parasitic element is provided in proximity to the first and second feeding elements so as to be electromagnetically coupled to the first and second feeding elements. The second parasitic element is provided in proximity to the first and second feeding elements so as to be electromagnetically coupled to the first and second feeding elements.

In the above-described antenna apparatus, the first feeding element and the first parasitic element are provided on the first surface of the first dielectric substrate, the second feeding element and the second parasitic element are provided on the first surface of the second dielectric substrate, and the first and second dielectric substrates are formed in an integrated dielectric substrate so that the second surface of the first dielectric substrate and the second surface of the second dielectric substrate are opposed to each other.

In addition, in the above-described antenna apparatus, each of the first and second parasitic elements is a dipole element including two parasitic conductor elements each having an electrical length of a quarter-wavelength, the two parasitic conductor elements being provided on a straight line. The controller means includes a PIN diode connected in series between the two parasitic conductor elements of the first parasitic element, and a PIN diode connected in series between the two parasitic conductor elements of the second parasitic element.

Further, in the above-described antenna apparatus, each of the first and second parasitic elements is a dipole element including two parasitic conductor elements each having an electrical length of a quarter-wavelength, the two parasitic conductor elements being provided on a straight line. The controller means includes a varactor diode connected in series between the two parasitic conductor elements of the first parasitic element, and a varactor diode connected in series between the two parasitic conductor elements of the second parasitic element.

Still further, in the above-described antenna apparatus, each of the first and second parasitic elements is a monopole element including one parasitic conductor element, which has an electrical length of a quarter-wavelength and is provided vertically with respect to a ground conductor. The controller means includes a PIN diode connected between the parasitic conductor element of the first parasitic element and the ground conductor, and a PIN diode connected between the parasitic conductor element of the second parasitic element and the ground conductor.

In addition, in the above-described antenna apparatus, each of the first and second parasitic elements is a monopole element including one parasitic conductor element, which has an electrical length of a quarter-wavelength and is provided vertically with respect to a ground conductor. The controller means includes a varactor diode connected between the parasitic conductor element of the first parasitic element and the ground conductor, and a varactor diode connected between the parasitic conductor element of the second parasitic element and the ground conductor.

Further, in the above-described antenna apparatus, each of the first and second feeding elements is a dipole antenna.

Still further, in the above-described antenna apparatus, each of the first and second feeding elements is a sleeve antenna.

In addition, in the above-described antenna apparatus, each of the first and second feeding elements is a monopole antenna.

Further, in the above-described antenna apparatus, the first parasitic element is provided to be away from the first and second feeding elements by a distance of a quarter-wavelength, and the second parasitic element is provided to be away from the first and second feeding elements by the distance corresponding to the quarter-wavelength.

Still further, the above-described antenna apparatus includes one first feeding element, two first parasitic elements, two second feeding elements, and two second parasitic elements.

In addition, the above-described antenna apparatus includes at least one first feeding element, at least one first parasitic element, at least one second feeding element, and at least one second parasitic element.

Advantageous Effects of Invention

According to the antenna apparatus of the present invention, an electrical length switch circuit for switching over between activation and non-activation of a parasitic element as a reflector is connected to each of the first parasitic element provided on the first dielectric substrate and the second parasitic element provided on the second dielectric substrate as the controller means. Each of the electrical length switch circuits is configured to use a PIN diode or a variable reactance element. When an appropriate voltage is applied to the electrical length switch circuit, the parasitic element connected to the electrical length switch circuit operates as a reflector. In this case, the first parasitic element is provided in proximity to the first and second feeding elements so as to be electromagnetically coupled to the first and second feeding elements, and the second parasitic element is provided in proximity to the first and second feeding elements so as to be electromagnetically coupled to the first and second feeding elements. Therefore, when one parasitic element is activated as a reflector, main radiation directions of the first and second feeding elements change.

Therefore, it is possible to increase and decrease a radiation power in a normal direction of the first and second dielectric substrates, and it is possible to control so as to obtain an optimal combination of directivities of the respective feeding elements. Accordingly, it is possible to provide an antenna apparatus having a directivity switching function suitable for the MIMO communication system. In addition, in the case where the first and second dielectric substrates are formed as an integrated block (which is a dielectric substrate) and all of the elements are provided on this integrated block, this integrated block can be mounted on a surface of a wireless module substrate by soldering or the like. Therefore, it becomes possible to neglect a propagation loss which is normally caused by a coaxial cable.

DESCRIPTION OF EMBODIMENTS

Figure 1:
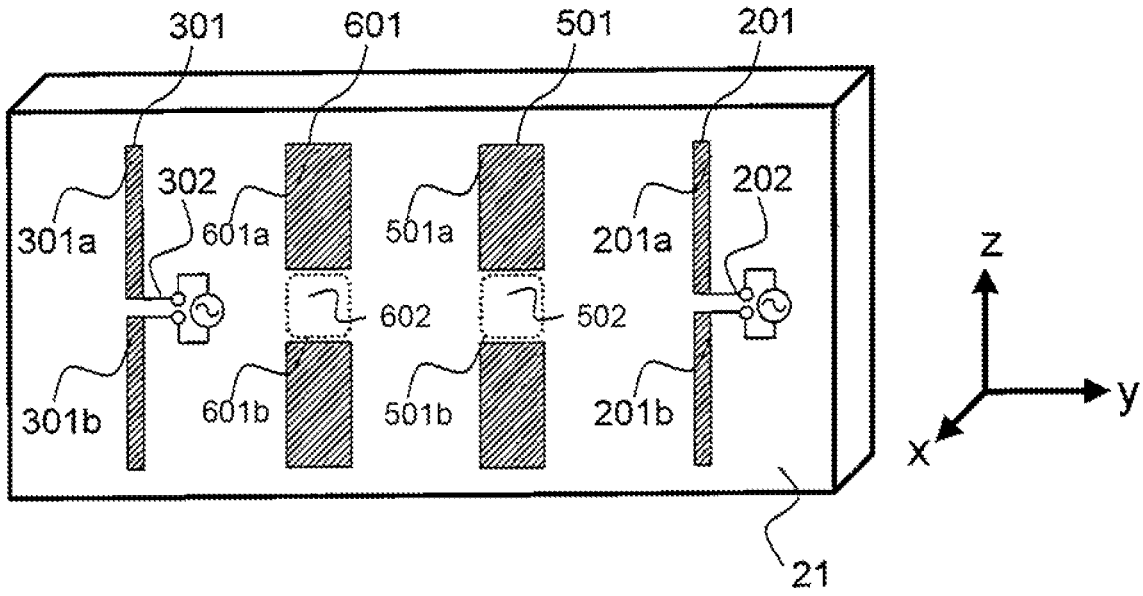
FIG. 1 is a perspective view when an antenna apparatus according to a first preferred embodiment of the present invention is seen from a front side thereof.

Preferred embodiments according to the present invention will be described below with reference to the attached drawings. In the specification and the drawings, components similar to each other are denoted by the same reference numerals, and are not described repeatedly.

First Preferred Embodiment

Figure 2:
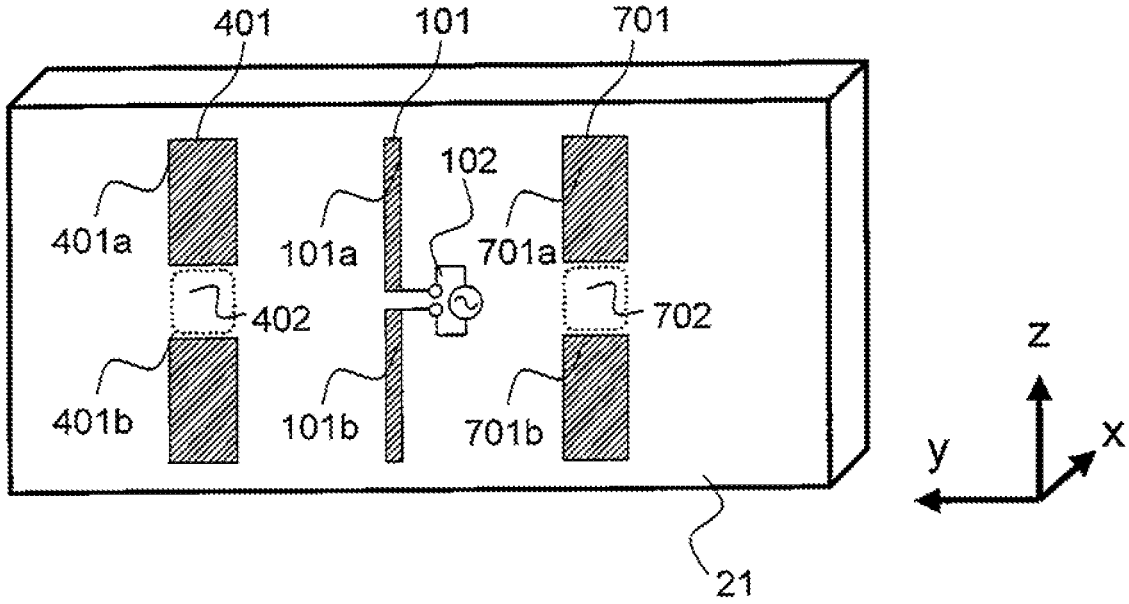
FIG. 2 is a perspective view when the antenna apparatus of FIG. 1 is seen from a back side thereof.
Figure 3:
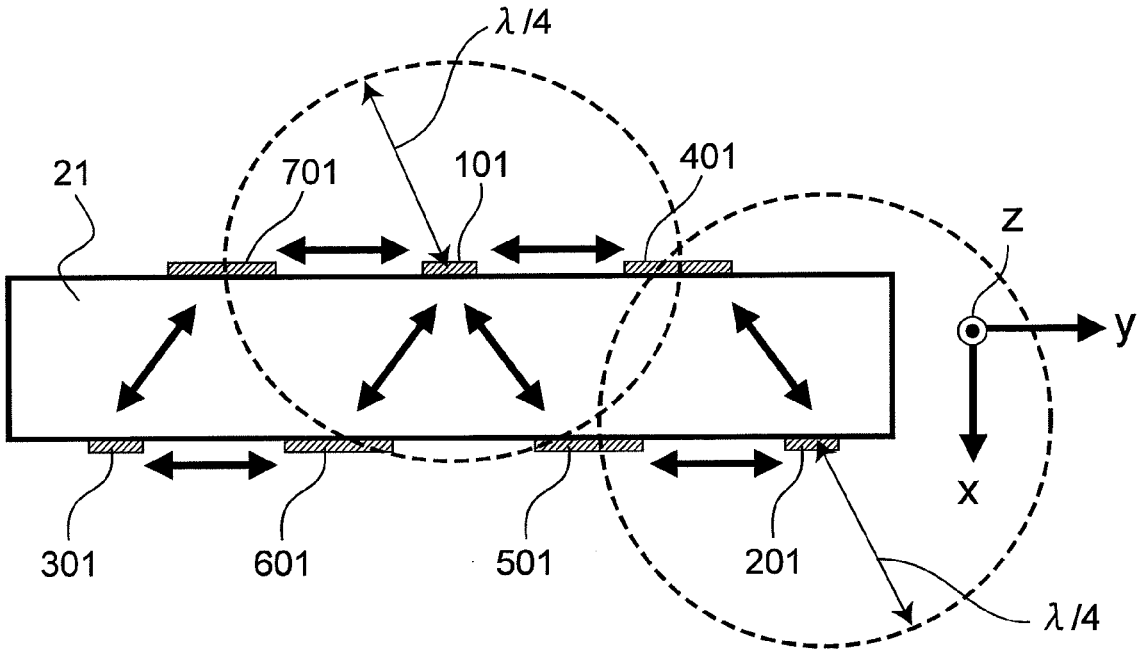
FIG. 3 is a top view of the antenna apparatus of FIGS. 1 and 2.

FIG. 1 is a perspective view when an antenna apparatus according to a first preferred embodiment of the present invention is seen from a front side thereof, and FIG. 2 is a perspective view when the antenna apparatus of FIG. 1 is seen from a back side thereof. In addition, FIG. 3 is a top view of the antenna apparatus of FIGS. 1 and 2. The antenna apparatus according to the present preferred embodiment is configured to include three dipole antenna elements 101, 201 and 301, and four parasitic antenna elements (that are parasitic elements) 401, 501, 601 and 701 each provided on a dielectric substrate 21. In addition, a three-dimensional XYZ coordinate is adopted as shown in FIGS. 1 to 3.

As will be described later in detail, the antenna apparatus according to the present preferred embodiment has the following features. Namely, the antenna apparatus includes the dielectric substrate 21, the feeding antenna element 101 formed on one surface of the dielectric substrate 21 to transmit and receive a wireless signal, the parasitic antenna elements 401 and 701 formed on the one surface of the dielectric substrate 21, the feeding antenna elements 201 and 301 formed on another surface of the dielectric substrate 21 to transmit and receive a wireless signal, the parasitic antenna elements 501 and 601 formed on the another surface of the dielectric substrate, and a controller 1 and electrical length adjustor circuits 401, 502, 602 and 702 for switching over between activation and non-activation of each of the parasitic elements 402, 501, 601 and 701 as a reflector. The parasitic antenna element 401 is provided in proximity to the feeding antenna elements 101 and 201 so as to be electromagnetically coupled to the feeding antenna elements 101 and 201. The parasitic antenna element 501 is provided in proximity to the feeding antenna elements 101 and 201 so as to be electromagnetically coupled to the feeding antenna elements 101 and 201. The parasitic antenna element 601 is provided in proximity to the feeding antenna elements 101 and 301 so as to be electromagnetically coupled to the feeding antenna elements 101 and 301. The parasitic antenna element 701 is provided in proximity to the feeding antenna elements 101 and 301 so as to be electromagnetically coupled to the feeding antenna elements 101 and 301.

The dipole antenna element 101 is configured to include two strip-shaped feeding conductor elements 101*a* and 101*b* which are formed in a form of conductor pattern on the surface of the dielectric substrate 21. The feeding conductor elements 101*a* and 101*b* are arranged on a straight line with a predetermined gap therebetween. A feeding point 102 is provided on one side the feeding conductor elements 101*a* and one side of the feeding conductor elements 101*b* opposed to each other. The feeding point 102 is connected to a wireless communication circuit (not shown), so that a wireless signal is transmitted and received via the dipole antenna element 101.

The parasitic antenna elements 401 and 701 are arranged so that the dipole antenna element 101 is arranged therebetween. The parasitic antenna element 401 lies on a line which is parallel to and away from the line, on which the antenna element 101 is located, by a distance corresponding to one-fourth of an operating wavelength λ in communication. The parasitic antenna element 701 lies on a line which is parallel to and away from the line, on which the antenna element 101 is located, by the distance corresponding to one-fourth of the operating wavelength λ in communication. In addition, the parasitic antenna elements 501 and 601 are arranged on a surface of the dielectric substrate opposed to the surface on which the dipole antenna element 101 is formed. The parasitic antenna element 501 lies on a line which is parallel to and away from the line, on which the antenna element 101 is located, by the distance corresponding to one-fourth of the operating wavelength λ in communication. The parasitic antenna element 601 lies on a line which is parallel to and away from the line, on which the antenna element 101 is located, by the distance corresponding to one-fourth of the operating wavelength λ in communication. In this case, the distance corresponding to one-fourth of the operating wavelength λ is set to such a distance that the dipole antenna element, and the parasitic antenna element are electromagnetically coupled to each other. The distance changes according to a dielectric constant of a dielectric substrate to be used, and becomes shorter as the dielectric constant is larger.

The parasitic antenna element 401 is a dipole element configured to include two strip-shaped feeding conductor elements 401*a* and 401*b* which are formed in a form of conductor pattern of the dielectric substrate 21. In this case, each of the parasitic conductor elements 401*a* and 401*b* has an electrical length of a quarter-wavelength (λ/4), and is arranged on a straight line with a predetermined gap therebetween. The electrical length adjustor circuit 402 is provided on one side of the parasitic conductor elements 401*a* and one side of the parasitic conductor elements 401*b* opposed to each other.

Figure 4:
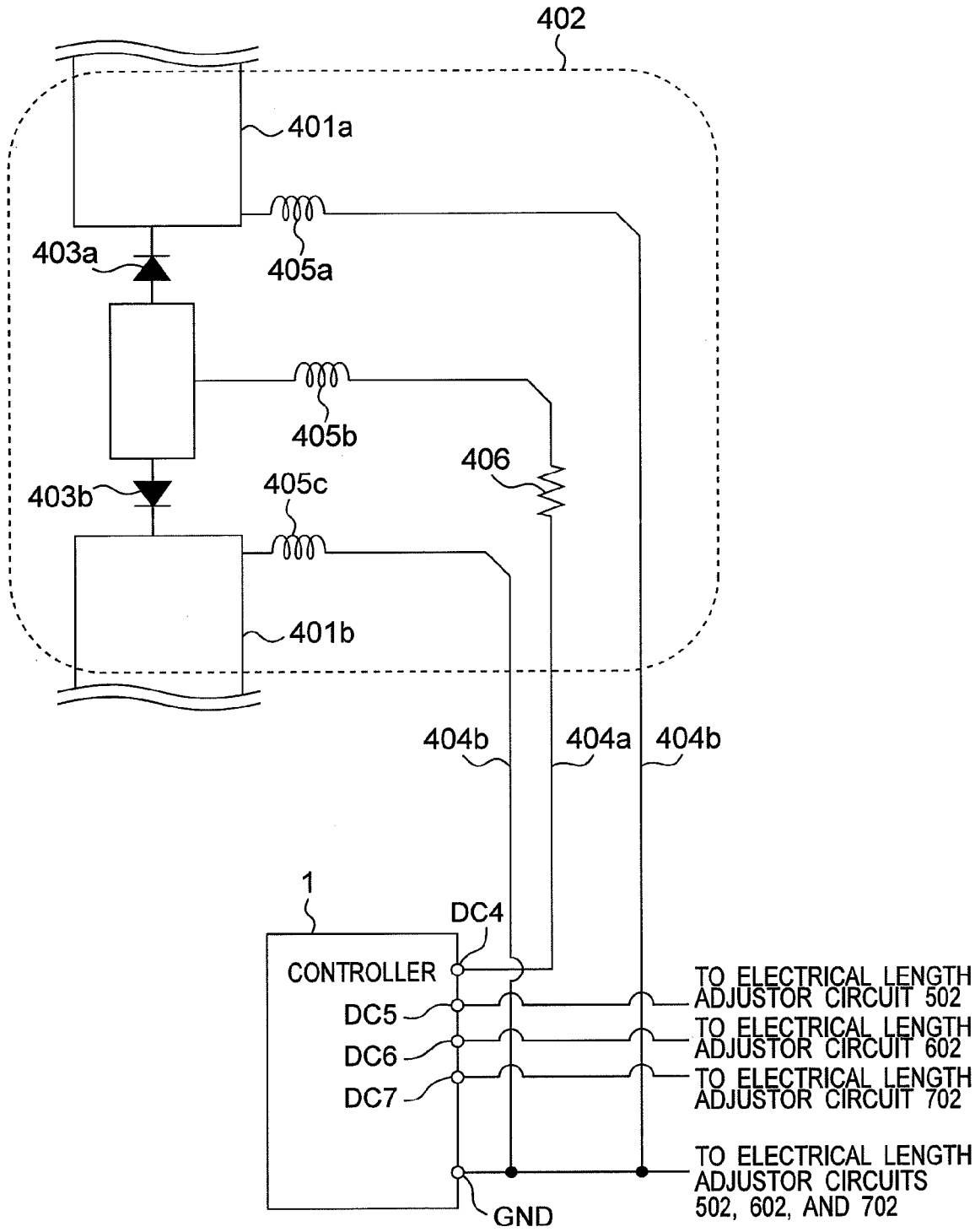
FIG. 4 is an enlarged view of an electrical length adjustor circuit 402 of the antenna apparatus of FIG. 2.

FIG. 4 is an enlarged view of the electrical length adjustor circuit 402 of the antenna apparatus of FIG. 2. Concretely speaking, FIG. 4 shows a portion including the electrical length adjustor circuit 402 and the parasitic conductor elements 401*a* and 401*b* provided in proximity to the electrical length adjustor circuit 402.

Referring to FIG. 4, a pair of PIN diodes 403*a* and 403*b* are provided on opposed sides of the parasitic conductor elements 401*a* and 401*b*. A cathode terminal of the PIN diode 403*a* is connected to the parasitic conductor element 401*a*, a cathode terminal of the PIN diode 403*b* is connected to the parasitic conductor element 401*b*, and anode terminals of the PIN diodes 403*a* and 403*b* are connected to each other. The anode terminals of the PIN diodes 403*a* and 403*b* are connected to an applied bias voltage terminal (a DC terminal) DC4 of the controller 1 via a control line 404*a*. The controller applies a control voltage (i.e., a bias voltage) to control the directional pattern of the antenna apparatus. The cathode terminals of the PIN diodes 403*a* and 403*b* are connected to a ground terminal (a GND terminal) GND of the controller 1 via control lines 404*b*. Therefore, the control lines 404*a* and 404*b* are a direct-current voltage supply line and a GND line for controlling the parasitic antenna element 401, respectively. On the control line 404*a*, a high-frequency stopping inductor (coil) 405*b* having an inductance of about several tens of nanohenries, for example, is provided in proximity to the anode terminals of the PIN diodes 403*a* and 403*b*. Further, a current controlling resistor 406 having a resistance of about several kiloohms is provided on the control line 404*a*. In addition, on the control lines 404*b*, high-frequency stopping inductors 405*a* and 405*c* each having an inductance of about several tens of nanohenries, for example, are provided in proximity to the cathode terminals of the PIN diodes 403*a* and 403*b*. In this case, the inductors 405*a*, 405*b* and 405*c* prevent high-frequency signals, which excite at the parasitic antenna element 401, from leaking to the control lines 404*a* and 404*b*.

The parasitic antenna elements 501, 601 and 701 are also configured in a manner similar to that of the parasitic antenna element 401. The parasitic antenna element 501 is configured to include two strip-shaped parasitic conductor elements 501*a* and 501*b*, and the electrical length adjustor circuit 502 provided on one side of the parasitic conductor element 501*a* and one side of the parasitic conductor element 501*b* opposed to each other. The parasitic antenna element 601 is configured to include two strip-shaped parasitic conductor elements 601*a* and 601*b*, and the electrical length adjustor circuit 602 provided on one side of the parasitic conductor element 601*a* and one side of the parasitic conductor element 601*b* opposed to each other. The parasitic antenna element 701 is configured to include two strip-shaped parasitic conductor elements 701*a* and 701*b*, and the electrical length adjustor circuit 702 provided on one side of the parasitic conductor element 701*a* and one side of the parasitic conductor element 701*b* opposed to each other. In addition, the electrical length adjustor circuits 502, 602 and 702 are also configured in a manner similar to that of the electrical length adjustor circuit 402. In this case, respective anode terminals of two PIN diodes of the electrical length adjustor circuit 502 are connected to an applied bias voltage terminal DC5 of the controller 1, and respective cathode terminals of the two PIN diodes of the electrical length adjustor circuit 502 are connected to the ground terminal GND. Respective anode terminals of two PIN diodes of the electrical length adjustor circuit 602 are connected to an applied bias voltage terminal DC6 of the controller 1, and respective cathode terminals of the two PIN diodes of the electrical length adjustor circuit 602 are connected to the ground terminal GND. Respective anode terminals of two PIN diodes of the electrical length adjustor circuit 702 are connected to an applied bias voltage terminal DC7 of the controller 1, and respective cathode terminals of the two PIN diodes of the electrical length adjustor circuit 702 are connected to the ground terminal GND.

Further, the dipole antenna elements 201 and 301 are also configured in a manner similar to that of the dipole antenna element 101.

FIG. 3 is a plan view when the antenna apparatus according to the first preferred embodiment of the present invention is seen from a top side thereof. As described above, the parasitic antenna elements 401, 501, 601 and 701 are provided at the positions away from the dipole antenna element 101 by the distance corresponding to one-fourth of the operating wavelength λ in communication. This distance depends on the dielectric constant of the dielectric substrate to be used.

The dipole antenna element 201 is provided at a position away from the parasitic antenna element 401 and the parasitic antenna element 501 by the distance corresponding to one-fourth of the operating wavelength λ in communication. In addition, the dipole antenna element 301 is arranged at a position away from the parasitic antenna element 601 and the parasitic antenna element 701 by the distance corresponding to one-fourth of the operating wavelength λ in communication.

In the antenna apparatus configured as described above, when the control voltage from the controller 1 is in its OFF state, no voltage is applied to the PIN diodes of all of the electrical length adjustor circuits 402, 502, 602 and 702. Therefore, the parasitic antenna elements 401, 501, 601 and 701 are not excited. As a result, the parasitic antenna elements 401, 501, 601 and 701 does not influence on the directional patterns of the dipole antenna elements 101, 201 and 301.

On the other hand, when the controller 1 turns on the control voltage to, for example, the parasitic antenna element 401, the applied bias voltage from the DC terminal DC4 is applied to the anodes of the PIN diodes 403*a* and 403*b* via the control line 404*a*. By setting the applied bias voltage to a voltage higher than an operating voltage of the PIN diodes 403*a* and 403*b*, which is about 0.8 V, for example, each of the PIN diodes 403*a* and 403*b* is put into its conductive state. In this case, the parasitic antenna element 401 is excited by a radio wave radiated from the dipole antenna element 101, and reradiates a radio wave. Since the gap between the dipole antenna element 101 and the parasitic antenna element 401 is set to one-fourth of the operating wavelength λ, a phase of the radio wave reradiated from the parasitic antenna element 401 is delayed from a phase of the radio wave radiated from the dipole antenna element 101 by 90 degrees. By the superposition of the two radio waves, the radio wave directed to a +Y direction relative to the parasitic antenna element 401 is canceled, and the radio wave directed to a −Y direction relative to the dipole antenna element 101 is enhanced.

In addition, in this case, the parasitic antenna element 401 is also excited by a radio wave radiated from the dipole antenna element 201, and reradiates a radio wave. Since the gap between the dipole antenna element 201 and the parasitic antenna element 401 is set to one-fourth of the operating wavelength λ, a phase of the radio wave, which is reradiated from the parasitic antenna element 401, is delayed from a phase of the radio wave radiated from the dipole antenna element 201 by 90 degrees. By the superposition of the two radio waves, the radio wave directed to a −(X+Y) direction relative to the parasitic antenna element 401 is canceled, and the radio wave directed to a +(X+Y) direction relative to the dipole antenna element 101 is enhanced. As described above, when the bias voltage is applied to the electrical length adjustor circuit 402 connected to the parasitic antenna element 401, the parasitic antenna element 401 acts as a reflector for the dipole antenna elements 101 and 201. Therefore, it is possible to switch the directional pattern of the dipole antenna element 101 to a state in which its main radiation is directed to the −Y direction, and to switch the directional pattern of the dipole antenna element 201 to a state in which its main radiation is directed to the +(X+Y) direction.

When the remaining parasitic antenna elements 501, 601 and 701 are turned on, it is also possible to control the directional pattern in a manner similar to that of the parasitic antenna element 401. For example, when the parasitic antenna element 401 and the parasitic antenna element 501 are turned on simultaneously, the main radiation of the directional pattern of the dipole antenna element 101 is directed to the −(X+Y) direction. As a different example, when the parasitic antenna element 501 and the parasitic antenna element 601 are turned on simultaneously, the main radiation of the directional pattern of the dipole antenna element 101 is directed to the −X direction.

Namely, the number of shapes of the directivity to be taken by the dipole antenna element 101 is $2^4=8$ ways, since the number of parasitic antenna elements, which exert an influence on the dipole antenna element 101, is four. The number of shapes of directivity to be taken by the dipole antenna elements 201 and 301 is $2^2=4$ ways, since the number of parasitic antenna elements, which exert an influence, is two.

Figure 5:
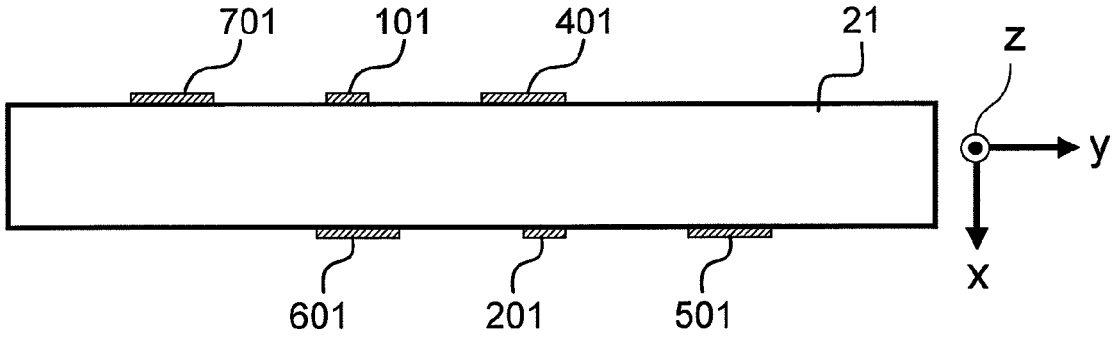
FIG. 5 is a top view of an antenna apparatus according to a first modified preferred embodiment of the first preferred embodiment of the present invention.

FIG. 5 is a top view of an antenna apparatus according to a first modified preferred embodiment of the first preferred embodiment of the present invention. FIG. 5 shows such a modified preferred embodiment that the antenna apparatus includes two dipole antenna elements 101 and 201, and four parasitic antenna elements 401, 501, 601 and 701.

Figure 6:
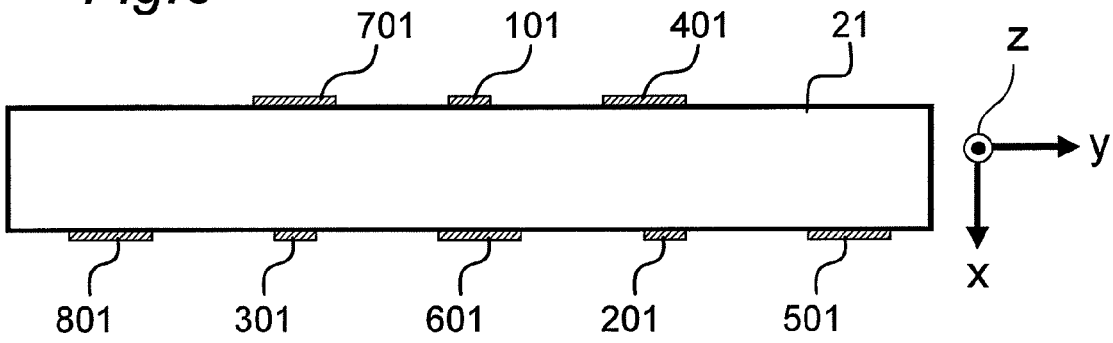
FIG. 6 is a top view of an antenna apparatus according to a second modified preferred embodiment of the first preferred embodiment of the present invention.

FIG. 6 is a top view of an antenna apparatus according to a second modified preferred embodiment of the first preferred embodiment of the present invention. FIG. 6 shows such a modified preferred embodiment that the antenna apparatus includes three dipole antenna elements 101, 201 and 301, and five parasitic antenna elements 401, 501, 601, 701 and 801.

Figure 7:
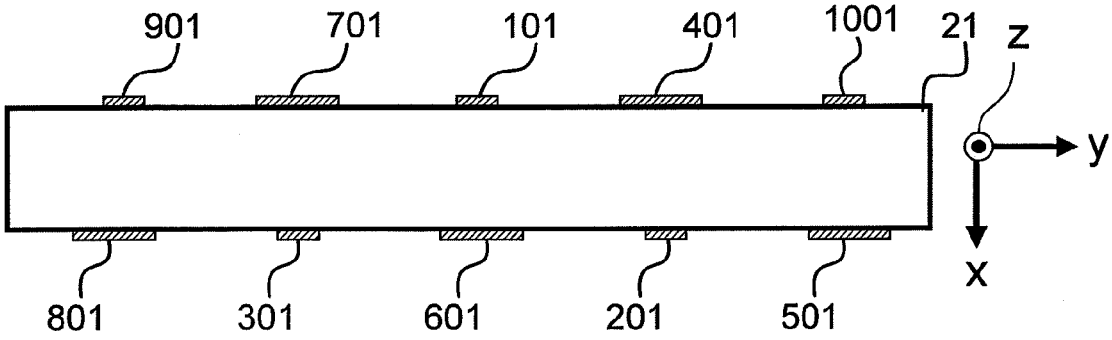
FIG. 7 is a top view of an antenna apparatus according to a third modified preferred embodiment of the first preferred embodiment of the present invention.

FIG. 7 is a top view of an antenna apparatus according to a third modified preferred embodiment of the first preferred embodiment of the present invention. FIG. 7 shows such a modified preferred embodiment that the antenna apparatus includes five dipole antenna elements 101, 201, 301, 901 and 1001, and five parasitic antenna elements 401, 501, 601, 701 and 801.

It should be noted that the present preferred embodiment represents the case where the dipole antenna elements 101, 201 and 301 are used as feeding elements, however, any element can be used as long as the element has a horizontal plane (X-Y plane) directional pattern which is almost equal to omnidirectional. Therefore, it is possible to realize an antenna apparatus that operates in a manner similar to that of the present preferred embodiment even in a case of using sleeve antennas, collinear antennas or monopole antennas. In addition, the present preferred embodiment represents the example that the two to five excitation antenna elements and the four to five parasitic antenna elements are arranged on the dielectric substrate 21. However, the number of the respective elements may be increased or decreased.

Figure 23:
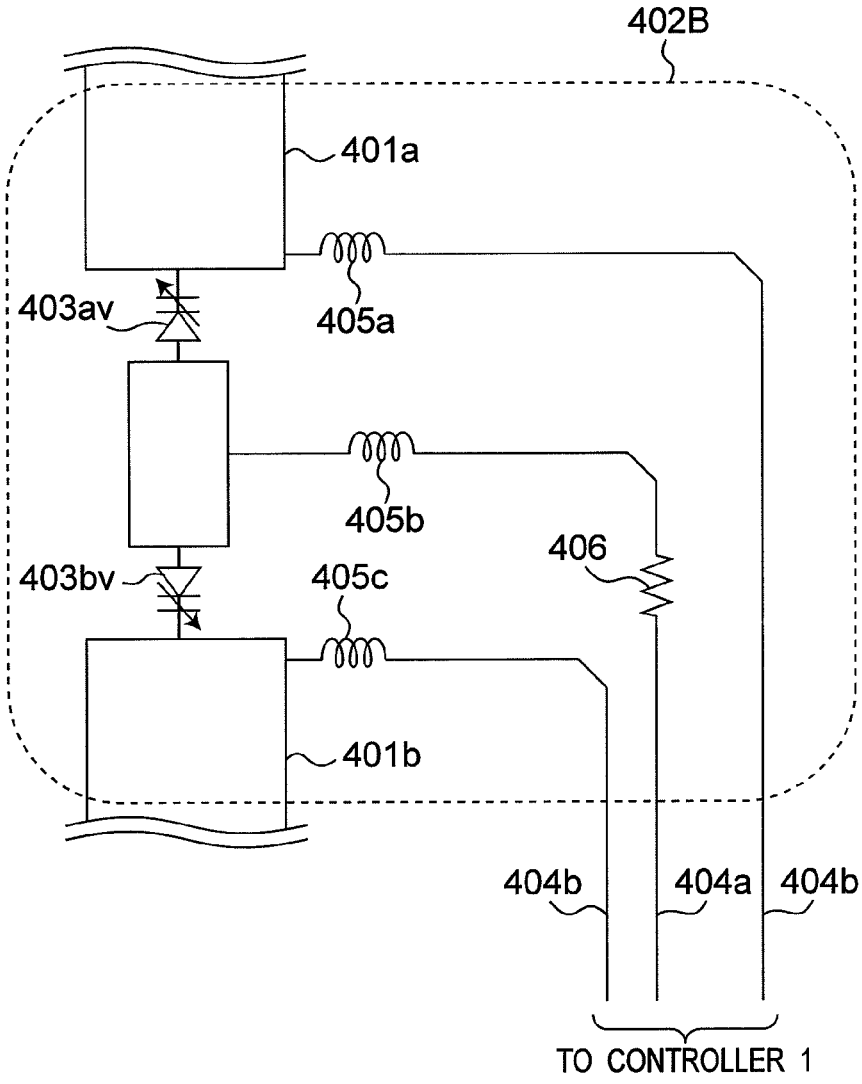
FIG. 23 is an enlarged view of an electrical length adjustor circuit 402B according to a fourth modified preferred embodiment of the first preferred embodiment of the present invention.

Further, the present preferred embodiment utilizes the conduction and non-conduction of the PIN diode to adjust the electric length. However, for example, varicap diodes (varactor diodes) 403*av* and 403*bv* may be used for switching the electrical length by changing a reactance value, as shown in FIG. 23. FIG. 23 is an enlarged view of an electrical length adjustor circuit 402B according to a fourth modified preferred embodiment of the first preferred embodiment of the present invention. The electrical length adjustor circuit 402B is different from the electrical length adjustor circuit 402A in such a point that the varicap diodes 403*av* and 403*bv* are provided instead of the PIN diodes 403*a* and 403*b*. Referring to FIG. 23, a cathode terminal of the varicap diode 403*av* is connected to the parasitic conductor element 401*a*, a cathode terminal of the varicap diode 403*bv* is connected to the parasitic conductor element 401*b*, and anode terminals of the varicap diodes 403*av* and 403*bv* are connected to each other. The anode terminals of the varicap diodes 403*av* and 403*bv* are connected to the applied bias voltage terminal DC4 of the controller 1 via the inductor 405*b*, the resistor 406 and the control line 404*a*. Further, the cathode terminal of the varicap diode 403*av* is connected to the ground terminal GND of the controller 1 via the inductor 405*a* and the control line 404*b*, and the cathode terminal of the varicap diode 403*bv* is connected to the ground terminal GND of the controller 1 via the inductor 405*c* and the control line 404*b*. The controller 1 successively changes bias voltages to be applied to the varicap diodes 403*av* and 403*bv* to change capacitance values of the respective varicap diodes 403*av* and 403*bv*, and successively changes the electrical length of le parasitic antenna element 401.

As described above, according to the antenna apparatus of the present preferred embodiment, the parasitic antenna elements 401, 501, 601 and 701 are arranged at the positions so as to be capable of simultaneously changing the directional pattern of the feeding element 101 on the first surface of the dielectric substrate 21 and the directional pattern of one of the feeding elements 201 and 301 on the second surface. Each of the feeding elements 101, 201 and 301 is arranged at the position so as to be influenced by one of the parasitic antenna elements 401 and 701 on the first surface and one of the parasitic antenna elements 501 and 601 on the second surface. Concretely speaking, the parasitic antenna element 401 is provided in proximity to the feeding antenna elements 101 and 201 so as to be electromagnetically coupled to the feeding antenna elements 101 and 201. The parasitic antenna element 501 is provided in proximity to the feeding antenna elements 101 and 201 so as to be electromagnetically coupled to the feeding antenna elements 101 and 201. The parasitic antenna element 601 is provided in proximity to the feeding antenna elements 101 and 301 so as to be electromagnetically coupled to the feeding antenna elements 101 and 301. The parasitic antenna element 701 is provided in proximity to the feeding antenna elements 101 and 301 so as to be electromagnetically coupled to the feeding antenna elements 101 and 301. Therefore, it is possible to increase and decrease electric power in the normal direction of the dielectric substrate 21, and it is possible to control so as to obtain an optimal combination of the directivities of the respective feeding elements 101, 201 and 301. Therefore, it is possible to provide a small-sized antenna apparatus having a directivity switching function suitable for a MIMO communication system. In addition, since all of the elements are located on the integrated block (corresponding to the dielectric substrate 21), this integrated block can be mounted on a surface of a wireless module substrate by soldering or the like. Therefore, it becomes possible to neglect a propagation loss which is normally caused by a coaxial cable.

Second Preferred Embodiment

Figure 8:
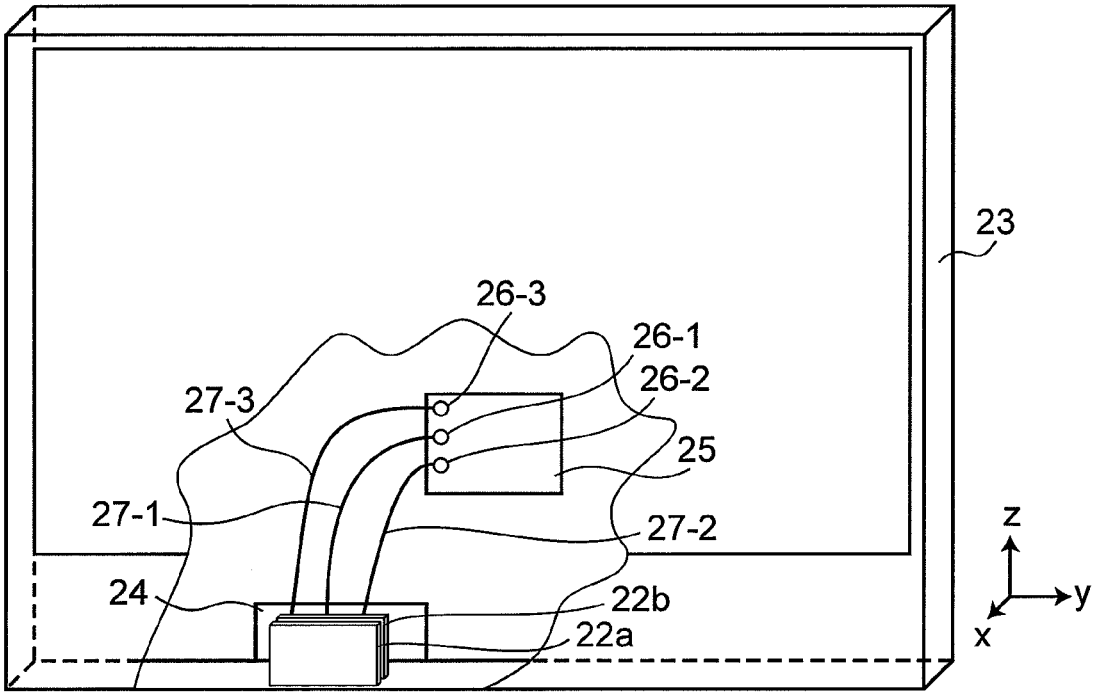
FIG. 8 is a perspective view of an antenna apparatus according to a second preferred embodiment of the present invention.
Figure 9:
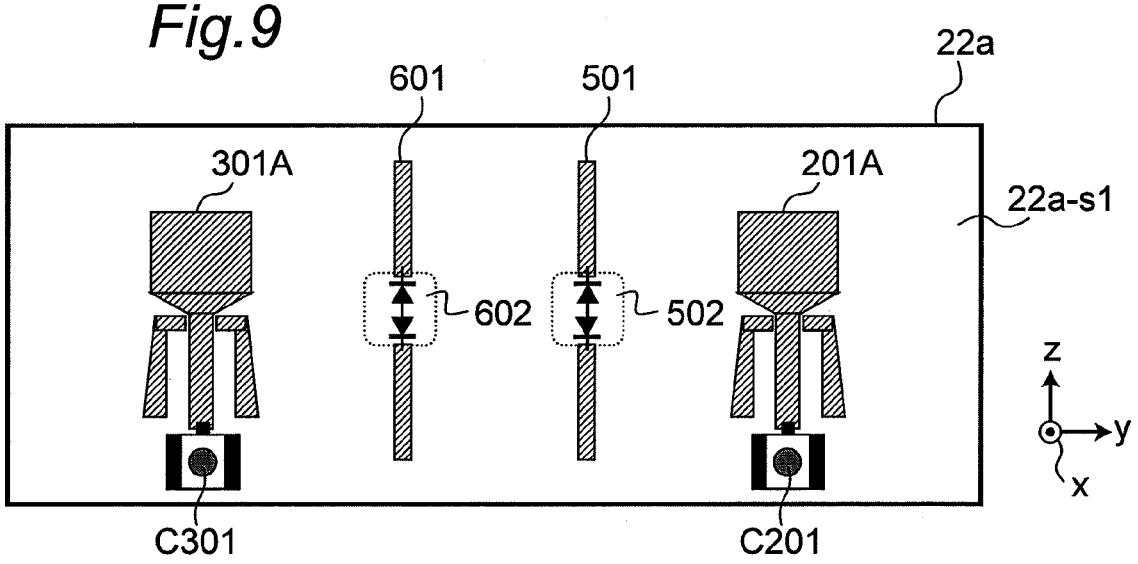
FIG. 9 is a front view of a printed circuit board 22*a* according to the second preferred embodiment of the present invention.
Figure 10:
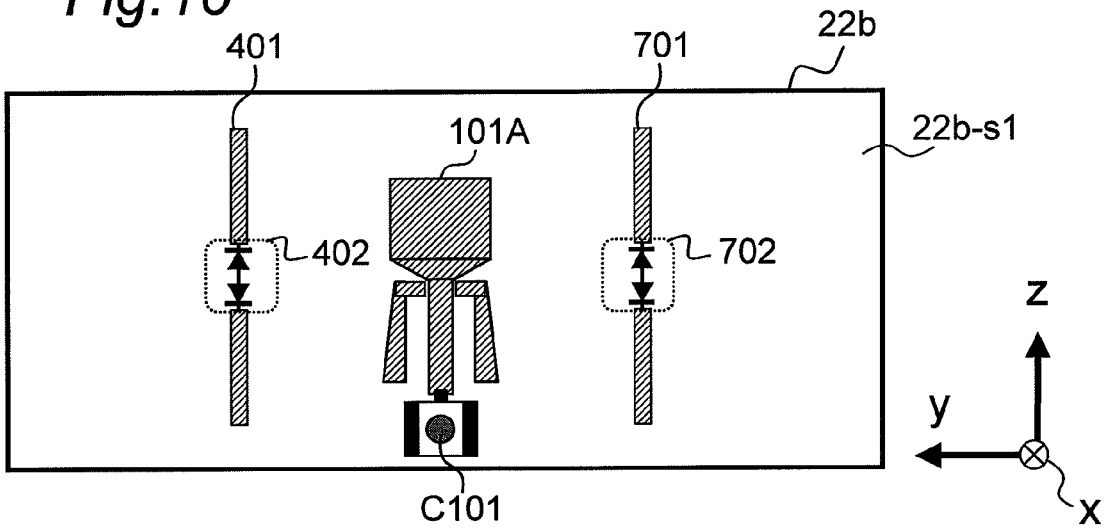
FIG. 10 is a front view of a printed circuit board 22*b* according to the second preferred embodiment of the present invention.

FIG. 8 is a perspective view of an antenna apparatus according to a second preferred embodiment of the present invention. In addition, FIG. 9 is a front view of a printed circuit board 22*a* according to the second preferred embodiment of the present invention, and FIG. 10 is a front view of a printed circuit board 22*b* according to the second preferred embodiment of the present invention.

As shown in FIG. 8, the antenna apparatus of the present preferred embodiment is configured to include the two printed circuit boards 22*a* and 22*b* formed by dielectric, which are provided in parallel with each other and arranged along a portion of a notch of a metal housing 23 of a display, where the notch has a plastic window 24 incorporated therein. In this case, the printed circuit board 22*a* has a first surface 22*a*-s1 and a second surface 22*a*-s2 which are in parallel with each other, and the printed circuit board 22*b* has a first surface 22*b*-s1 and a second surface 22*b*-s2 which are in parallel with each other. Further, the second surface 22*a*-s2 of the printed circuit board 22*a* and the second surface 22*b*-s2 of the printed circuit board 22*b* are opposed to each other. The antenna apparatus is configured to include sleeve antenna elements 101A, 201 and 301A which are a feeding antenna element, and parasitic antenna elements 401, 501, 601 and 701. The sleeve antenna element 101A and the parasitic antenna elements 401 and 701 are provided on the first surface 22*b*-s1 of the printed circuit board 22*b*, and the sleeve antenna elements 201A and 301A and the parasitic antenna elements 501 and 601 are provided on the first surface 22*a*-s1 of the printed circuit board 22*a*. A signal input and output terminal 26-1 on a wireless module substrate 25 and a connector C101 connected to the sleeve antenna element 101A on the printed circuit board 22*b* are connected to each other via a high-frequency coaxial cable 27-1, so that an electric current is fed to the sleeve antenna element 101A. In addition, a signal input and output terminal 26-2 on the wireless module substrate 25 and a connector C201 connected to the sleeve antenna element 201A on the printed circuit board 22*a* are connected to each other via a high-frequency coaxial cable 27-2, so that an electric current is fed to the sleeve antenna element 201A. Further, a signal input and output terminal 26-3 on the wireless module substrate 25 and a connector C301 connected to the sleeve antenna element 301A on the printed circuit board 22*a* are connected to each other via a high-frequency coaxial cable 27-3, so that an electric current is fed to the sleeve antenna element 301A.

Gaps among the elements including the sleeve antenna elements 101A, 201A and 301A and the parasitic antenna elements 401, 501, 601 and 701 are set in a manner similar to that of the first preferred embodiment. Namely, the parasitic antenna elements 401, 501, 601 and 701 are arranged at positions away from the sleeve antenna element 101A by a distance corresponding to one-fourth of an operating wavelength λ in communication. The sleeve antenna element 201A is arranged at a position away from the parasitic antenna element 401 and the parasitic antenna element 501 by the distance corresponding to one-fourth of the operating wavelength λ in communication. In addition, the sleeve antenna element 301A is arranged at a position away from the parasitic antenna element 601 and the parasitic antenna element 701 by the distance corresponding to one-fourth of the operating wavelength λ in communication. A distance between the dielectric substrates 22*a* and 22*b* is set so that the gaps among the sleeve antenna elements 101A, 201A and 301A and the parasitic antenna elements 401, 501, 601 and 701 are set as described above.

Operations of the antenna apparatus of the present preferred embodiment are described below with reference to FIGS. 9 and 10. For example, when no control voltage is applied to electrical length adjustor circuits 402, 502, 602 and 702 connected to the parasitic antenna elements 401, 501, 601 and 701, respectively, the directivity of the sleeve antenna element 101A extends omnidirectionally on an XY plane of FIG. 8, i.e., on a display screen. In order to direct the directivity of the sleeve antenna element 101A to a −X direction, a voltage is applied to the electrical length adjustor circuits 502 and 602. Therefore, the parasitic antenna elements 501 and 601 are excited to act as reflectors for the sleeve antenna element 101A. With respect to the sleeve antenna element 101A, an amplitude of a radio wave in a +X direction is weakened, and an amplitude of a radio wave in the −X direction is enhanced. Therefore, the directivity of the sleeve antenna element 101A is directed to the −X direction. In this case, it should be noted that the parasitic antenna element 501 also acts as a reflector for the sleeve antenna element 201A to change the directivity of the sleeve antenna element 201A to a +Y direction. In addition, the parasitic antenna element 601 changes the directivity of the sleeve antenna element 301A to a −Y direction in a manner similar to that of the parasitic antenna element 501.

In a manner similar to above, it is possible to obtain a combination of directivities in $2^4=16$ ways by changing combination of parasitic antenna elements to be excited (i.e., to be operated as a reflector).

Figure 11:
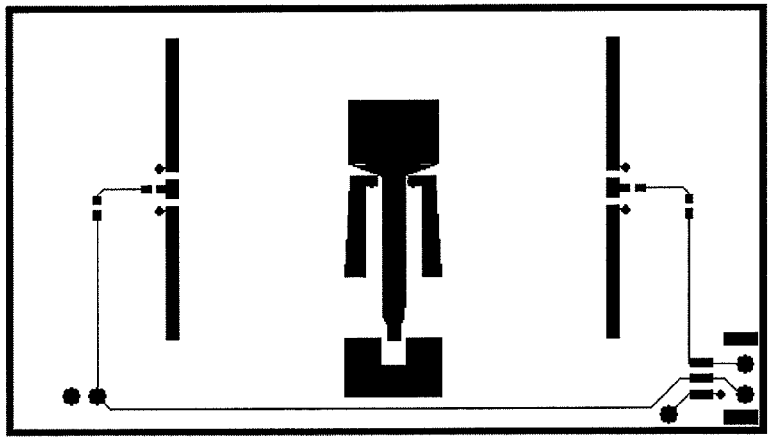
FIG. 11 is a front view showing a layout example of a first surface 22*b*-s1 of the printed circuit board 22*b* of FIG. 10.
Figure 12:
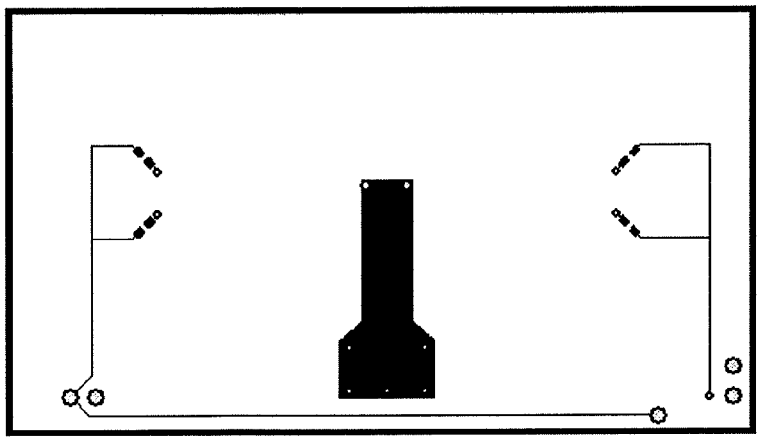
FIG. 12 is a front view showing a layout example of a second surface 22*b*-s2 of the printed circuit board 22*b* of FIG. 10.
Figure 13:
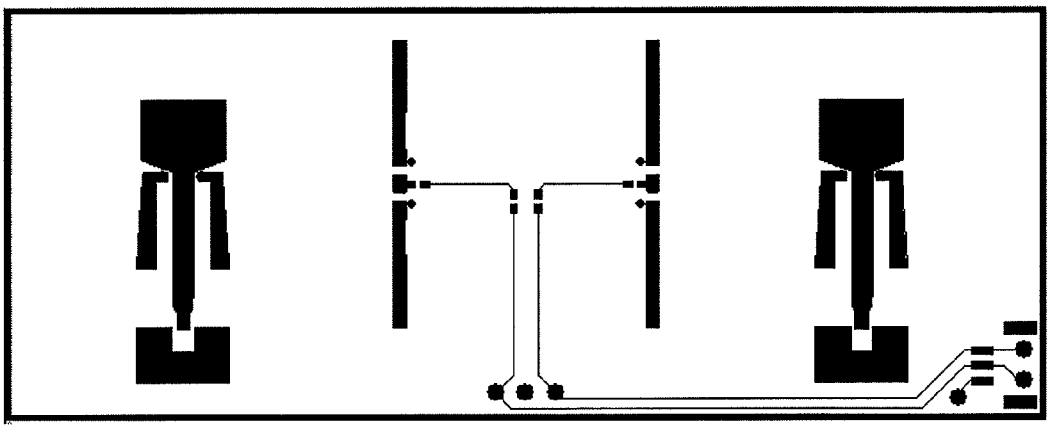
FIG. 13 is a front view showing a layout example of a first surface 22*a*-s1 of the printed circuit board 22*a* of FIG. 9.
Figure 14:
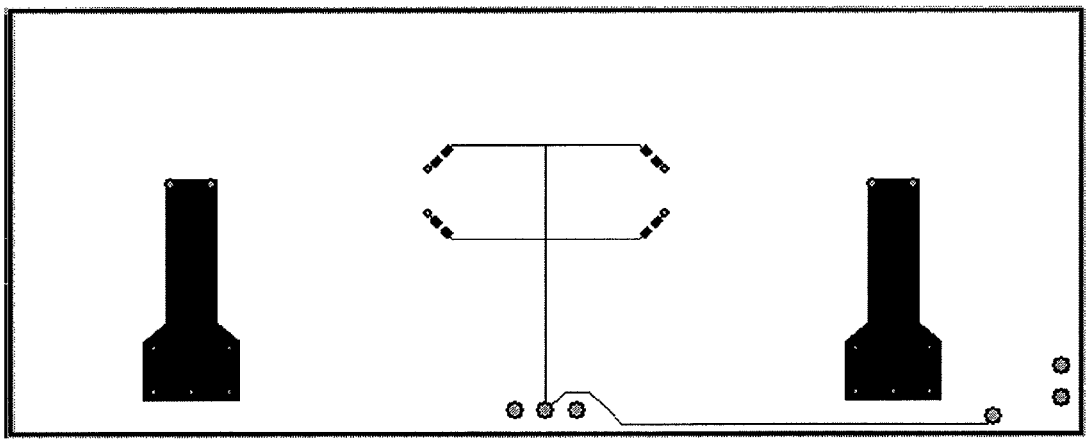
FIG. 14 is a front view showing a layout example of a second surface 22*a*-s2 of the printed circuit board 22*a* of FIG. 9.

FIG. 11 is a front view showing a layout example of the first surface 22*b*-s1 of the printed circuit board 22*b* of FIG. 10, and FIG. 12 is a front view showing a layout example of the second surface 22*b*-s2 of the printed circuit board 22*b* of FIG. 10. In addition, FIG. 13 is a front view showing a layout example of the first surface 22*a*-s1 of the printed circuit board 22*a* of FIG. 9, and FIG. 14 is a front view showing a layout example of the second surface 22*a*-s2 of the printed circuit board 22*a* of FIG. 9. Further, FIG. 15 is a horizontal plane directional pattern diagram when the parasitic antenna elements 401, 501, 601 and 701 are not operated (in their OFF states) in the antenna apparatus of FIG. 8, and FIG. 16 is a horizontal plane directional pattern diagram when the parasitic antenna elements 401, 501, 601 and 701 are operated (in their ON states) in the antenna apparatus of FIG. 8.

Figure 15:
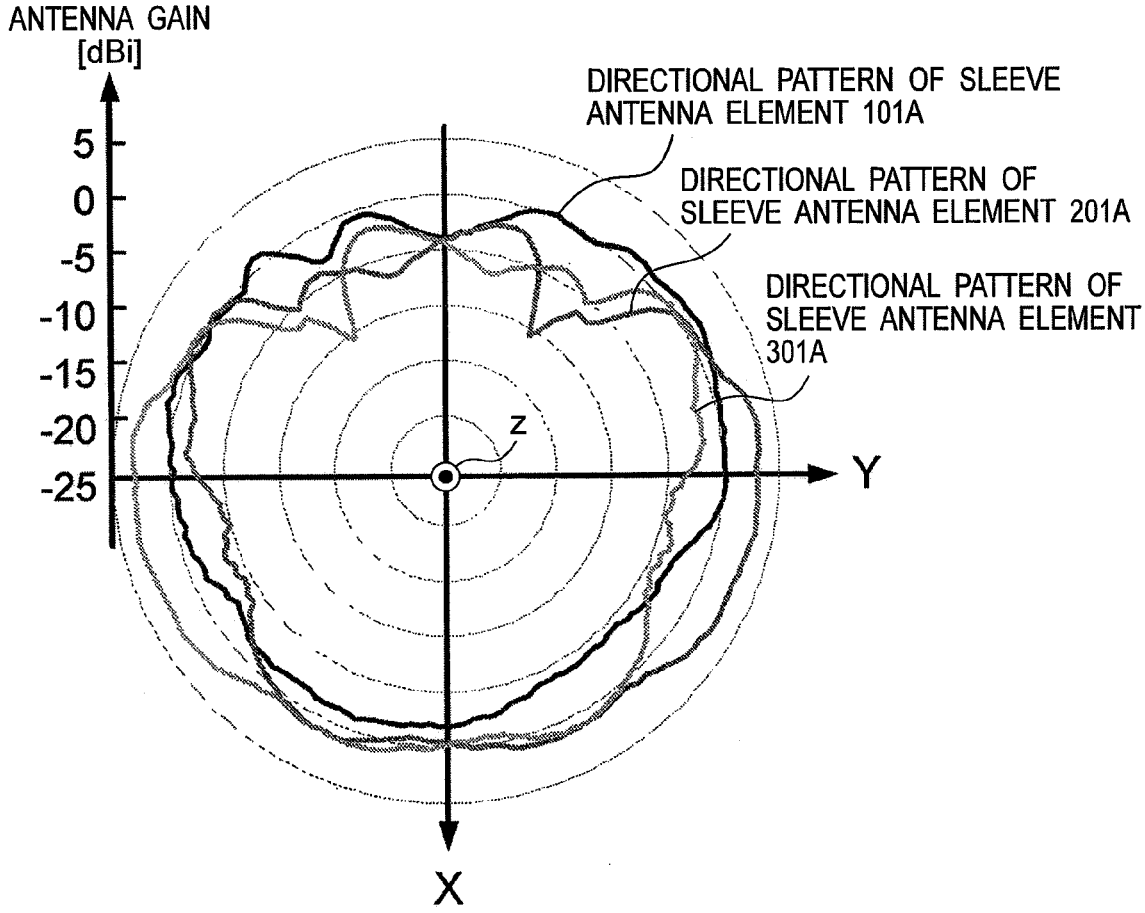
FIG. 15 is a horizontal plane directional pattern diagram when parasitic antenna elements 401, 501, 601 and 701 are not operated (in their OFF states) in the antenna apparatus of FIG. 8.
Figure 16:
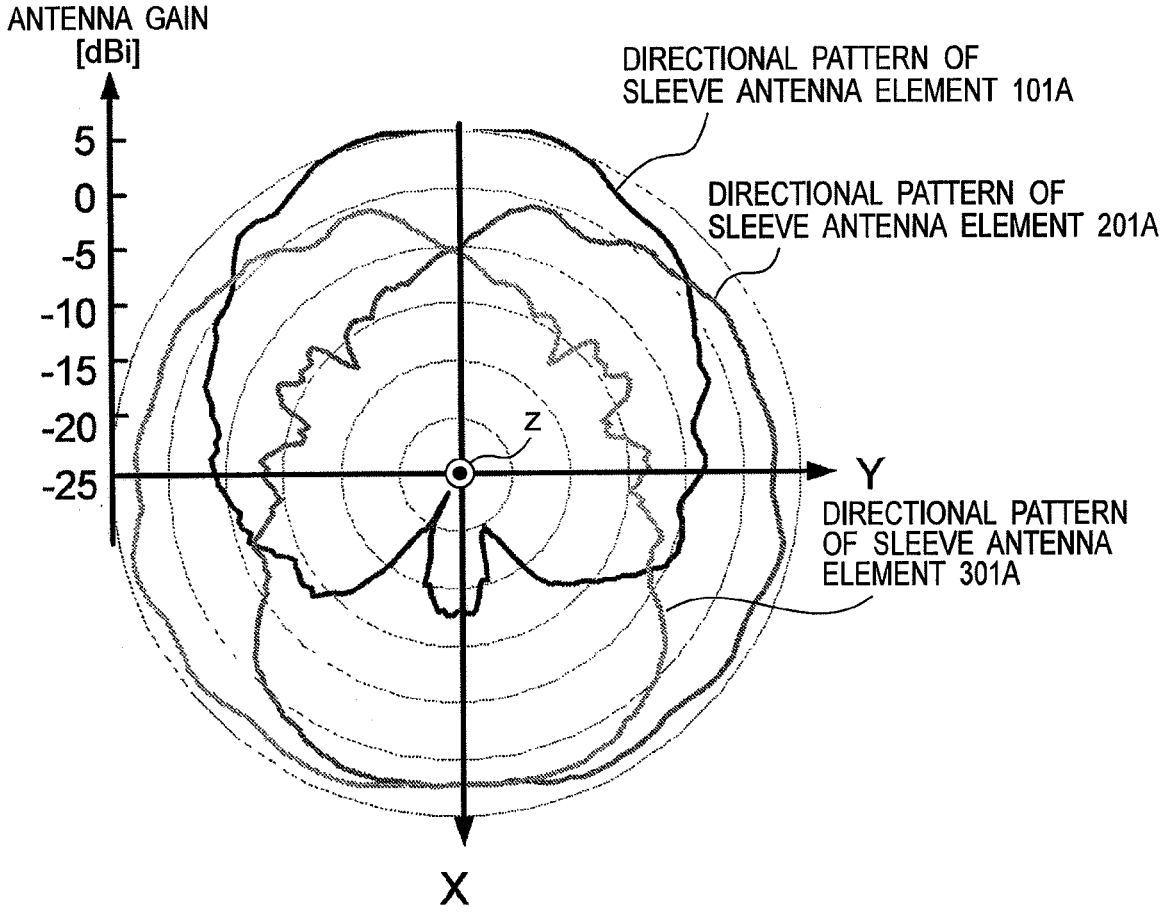
FIG. 16 is a horizontal plane directional pattern diagram when the parasitic antenna elements 401, 501, 601 and 701 are operated (in their ON states) in the antenna apparatus of FIG. 8.

Namely, FIGS. 11 to 14 show a layout of a printed circuit board in the present preferred embodiment, and FIGS. 15 and 16 show results of actual measurement of the directional patterns of the antenna elements on the printed circuit board of FIGS. 11 to 14 in an anechoic chamber. FIG. 15 is a graph showing directional patterns of the sleeve antenna elements 101A, 201A and 301A when the control voltages to the parasitic antenna elements 401, 501, 601 and 701 are turned off, and FIG. 16 is a graph showing the directional patterns of the sleeve antenna elements 101A, 201A and 301A when the control voltages to the parasitic antenna elements 401, 501, 601 and 701 are turned on.

Referring to FIG. 16, it is understood that the main radiation is directed to the −X direction by activating the parasitic antenna elements 501 and 601, which are located in the +X direction with respect to the sleeve antenna element 101A, as reflectors.

As described above, according to the antenna apparatus of the present preferred embodiment, the parasitic antenna elements 401, 501, 601 and 701 are arranged at the positions so as to be capable of simultaneously changing the directional pattern of the feeding element 101A on the first surface 22*b*-s1 of the printed circuit board 22*b* and the directional pattern of one of the feeding elements 201A and 301A on the first surface 22*a*-s1 of the printed circuit board 22*a*. Each of the feeding elements 101A, 201A and 301A is arranged at the position so as to be influenced by one of the parasitic antenna elements 401 and 701 on the surface 22*b*-s1 and one of the parasitic antenna elements 501 and 601 on the surface 22*a*-s1. Concretely speaking, the parasitic antenna element 401 is provided in proximity to the feeding antenna elements 101A and 201A so as to be electromagnetically coupled to the feeding antenna elements 101A and 201A. The parasitic antenna element 501 is provided in proximity to the feeding antenna elements 101A and 201A so as to be electromagnetically coupled to the feeding antenna elements 101A and 201A. The parasitic antenna element 601 is provided in proximity to the feeding antenna elements 101A and 301A so as to be electromagnetically coupled to the feeding antenna elements 101A and 301A. The parasitic antenna element 701 is provided in proximity to the feeding antenna elements 101A and 301A so as to be electromagnetically coupled to the feeding antenna elements 101A and 301A. Therefore, it is possible to increase and decrease electric power in the normal direction of the printed circuit boards 22*a* and 22*b*, and it is possible to control so as to obtain an optimal combination of the directivities of the respective feeding elements 101A, 201A and 301A. Therefore, it is possible to provide a small-sized antenna apparatus having a directivity switching function suitable for a MIMO communication system.

In this case, it is characterized that on the first surface 22*b*-s1 of the printed circuit board 22*b*, one feeding element 101A and two parasitic antenna elements 401 and 701 are arranged so that the feeding element 101A is arranged between the two parasitic antenna elements 401 and 701 so as to be away from the feeding element 101A by a distance of about a quarter-wavelength (λ/4). On the first surface 22*a*-s1 of the printed circuit board 22*a*, two feeding elements 201A and 301A and two parasitic antenna elements 501 and 601 are arranged so that the parasitic antenna elements 501 and 601 are arranged between the two feeding elements 201A and 301A and each of the gaps among the respective elements is the distance of about the quarter-wavelength (λ/4).

In the present preferred embodiment, the number of parasitic antenna elements is not limited to four, and a configuration that the number of parasitic antenna elements is three or less or the number of parasitic antenna elements is five or more may be also adoptable. In a manner similar to above, the number of sleeve antenna elements is not limited to three.

In addition, the preferred embodiment described above represents the example that the feeding antenna elements are configured as sleeve antenna elements. However, it is possible to realize an antenna apparatus that operates in a manner similar to that of the present preferred embodiment even in a case of using dipole antennas or collinear antennas. In addition, the feeding antenna elements and the parasitic antenna elements may be configured as monopole antenna elements provided on a ground conductor.

Third Preferred Embodiment

Figure 17:
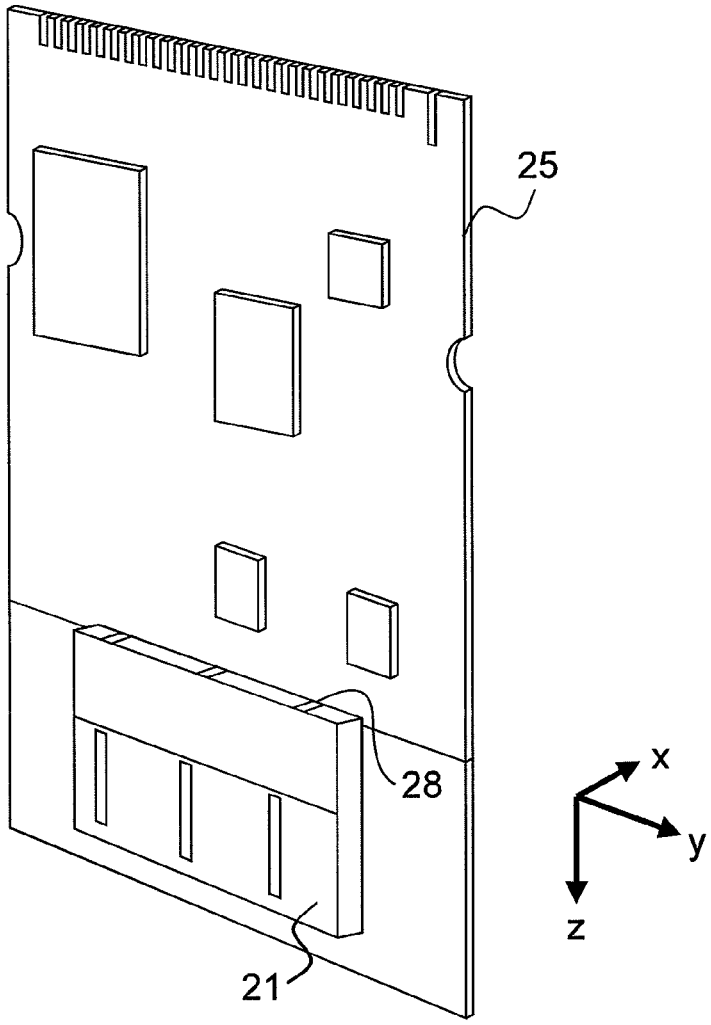
FIG. 17 is a perspective view showing a schematic configuration of a wireless module substrate 25 provided with an antenna apparatus according to a third preferred embodiment of the present invention.
Figure 18:
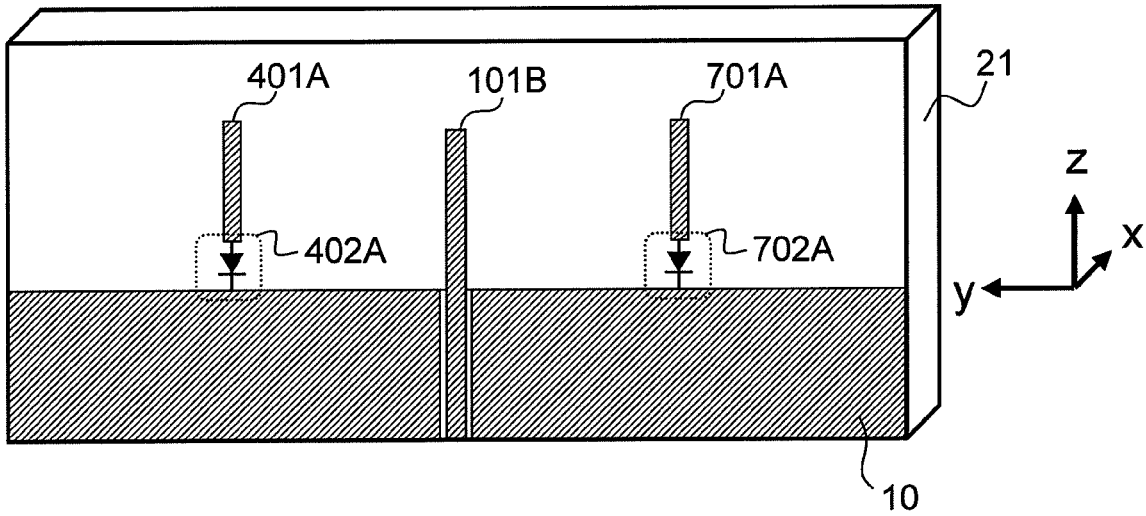
FIG. 18 is a perspective view when a dielectric substrate 21 of FIG. 17 is seen from a front side thereof.
Figure 19:
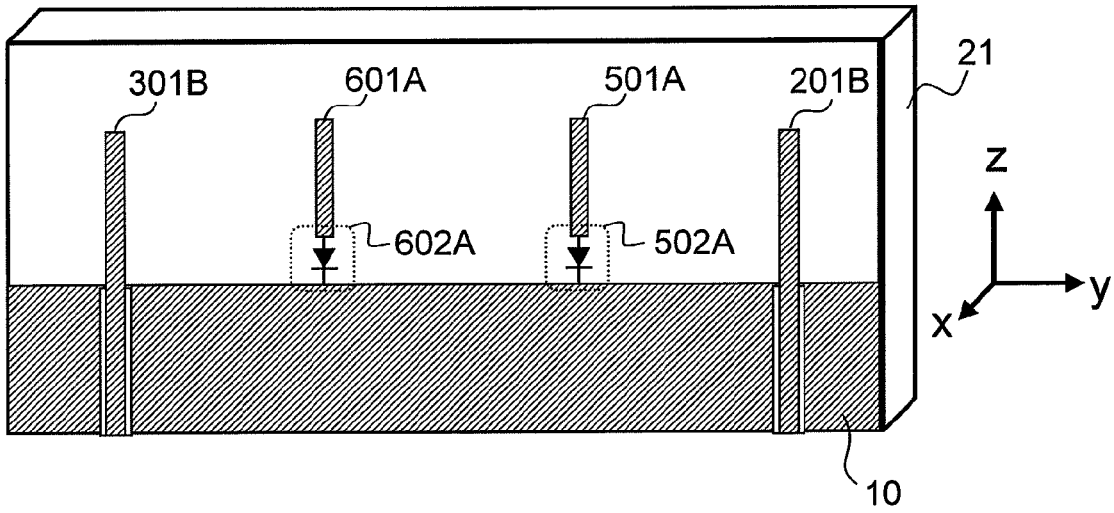
FIG. 19 is a perspective view when the dielectric substrate 21 of FIG. 17 is seen from a back side thereof.
Figure 20:
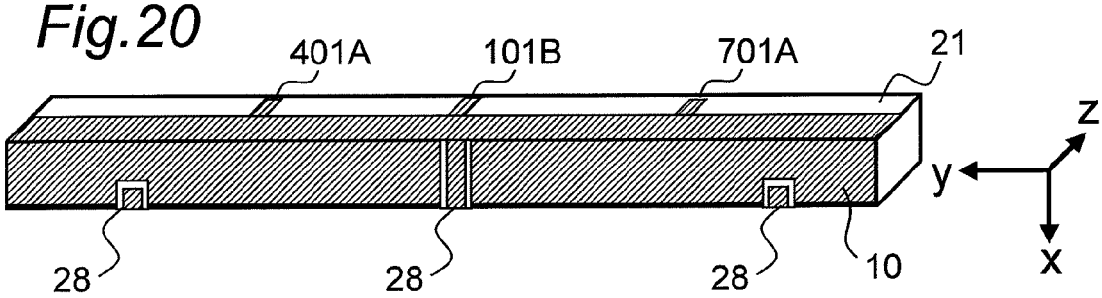
FIG. 20 is a perspective view when the dielectric substrate 21 of FIG. 17 is seen from a bottom side thereof.

FIG. 17 is a perspective view showing a schematic configuration of a wireless module substrate 25 provided with an antenna apparatus according to a third preferred embodiment of the present invention. In addition, FIG. 18 is a perspective view when a dielectric substrate 21 of FIG. 17 is seen from a front side thereof, FIG. 19 is a perspective view when the dielectric substrate 21 of FIG. 17 is seen from a back side thereof, and FIG. 20 is a perspective view when the dielectric substrate 21 of FIG. 17 is seen from a bottom side thereof. In this case, FIG. 17 shows a type of usage of the antenna apparatus according to the third preferred embodiment of the present invention.

Referring to FIGS. 17 to 20, the antenna apparatus of the present preferred embodiment is configured to include three monopole antenna elements 101B, 201B and 301B and four parasitic antenna elements 401A, 501A, 601A and 701A provided on the dielectric substrate 21. The monopole antenna element 101B and the parasitic antenna elements 401A and 701A are provided on the front surface of the dielectric substrate 21. The monopole antenna elements 201B and 301B and the parasitic antenna elements 501A and 601A are provided on the back surface of the dielectric substrate 21. In this case, the dielectric substrate 21 is mounted on the wireless module substrate 25 by attaching a feeder part 28 to the wireless module substrate 25 by soldering.

Gaps among the monopole antenna elements 101B, 201B and 301B and the parasitic antenna elements 401A, 501A, 601A and 701A are set in a manner similar to the case in the first preferred embodiment. Namely, each of the parasitic antenna elements 401A, 501A, 601A and 701A is arranged at a position away from the monopole antenna element 101B by the distance corresponding to one-fourth of an operating wavelength λ in communication. The monopole antenna element 201B is arranged at a position away from the parasitic antenna element 401A and the parasitic antenna element 501A by the distance corresponding to one-fourth of the operating wavelength λ in communication. In addition, the monopole antenna element 301B is arranged at a position away from the parasitic antenna element 601A and the parasitic antenna element 701A by the distance corresponding to one-fourth of the operating wavelength λ in communication.

The parasitic antenna element 401A is a monopole element which is configured to include one strip-shaped parasitic conductor element formed in the conductor pattern form on the dielectric substrate 21, and is provided vertically with respect to a ground conductor 10 of the dielectric substrate 21. In this case, the parasitic antenna element 401A has an electrical length of a quarter-wavelength. Further, an electrical length adjustor circuit 402A is provided between the parasitic antenna element 401A and the ground conductor 10.

Figure 21:
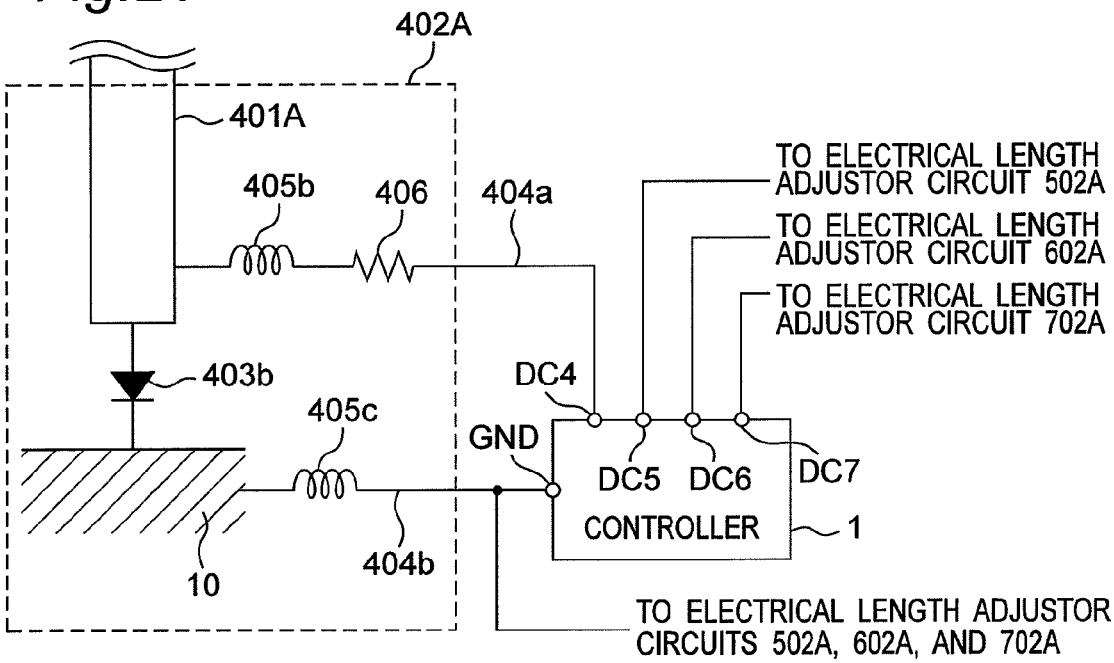
FIG. 21 is an enlarged view of an electrical length adjustor circuit 402A of the antenna apparatus of FIG. 17.

FIG. 21 is an enlarged view of the electrical length adjustor circuit 402A of the antenna apparatus of FIG. 17. Namely, FIG. 21 shows a portion including the electrical length adjustor circuit 402A and the parasitic antenna element 401A which is a parasitic conductor element provided in proximity to the electrical length adjustor circuit 402A. Referring to FIG. 21, a PIN diode 403*b* is connected between the parasitic antenna element 401A and the ground conductor. A cathode terminal of the PIN diode 403*b* is connected to the ground conductor 10, and an anode terminal of the PIN diode 403*b* is connected to the parasitic antenna element 401A. The anode terminal of the PIN diode 403*b* is connected to the applied bias voltage terminal DC4 of the controller 1 via a control line 404*a*. The controller 1 applies a control voltage (i.e., a bias voltage) to control a directional pattern of the antenna apparatus. The cathode terminal of the PIN diode 403*b* is connected to the ground terminal GND of the controller 1 via the ground conductor 10 and a control line 404*b*. Therefore, the control lines 404*a* and 404*b* are a direct-current voltage supply line and a GND line for controlling the parasitic antenna element 401A, respectively. On the control line 404*a*, a high-frequency stopping inductor (coil) 405*b* having an inductance of about several tens of nanohenries, for example, is provided in proximity to the anode terminal of the PIN diode 403*b*. Further, a current controlling resistor 406 having a resistance of about several kiloohms is provided on the control line 404*a*. In addition, on the control line 404*b*, a high-frequency stopping inductor 405*c* having an inductance of about several tens of nanohenries, for example, is provided in proximity to the cathode terminal of the PIN diode 403*b*. In this case, the inductors 405*b* and 405*c* prevents high-frequency signals, which excite the parasitic antenna element 401A, from leaking the control lines 404*a* and 404*b*.

The parasitic antenna elements 501A, 601A and 701A are also configured in a manner similar to that of the parasitic antenna element 401A. Namely, the parasitic antenna elements 501A, 601A and 701A are configured to include one strip-shaped parasitic conductor element provided vertically with respect to the ground conductor 10, and electrical length adjustor circuits 502A, 602A and 702A connected between the parasitic conductor elements and the ground conductor 10, respectively. Further, the electrical length adjustor circuits 502A, 602A and 702A are configured in a manner similar to that of the electrical length adjustor circuit 402A, respectively. In this case, an anode terminal of a PIN diode of the electrical length adjustor circuit 502A is connected to an applied bias voltage terminal DC5 of the controller 1, and a cathode terminal of the PIN diode of the electrical length adjustor circuit 502A is connected to the ground terminal GND. An anode terminal of one PIN diode of the electrical length adjustor circuit 602A is connected to an applied bias voltage terminal DC6 of the controller 1, and a cathode terminal of one PIN diode of the electrical length adjustor circuit 602 is connected to the ground terminal GND. An anode terminal of one PIN diode of the electrical length adjustor circuit 702A is connected to an applied bias voltage terminal DC7 of the controller 1, and a cathode terminal of one PIN diode of the electrical length adjustor circuit 702A is connected to the ground terminal GND.

Operations of the antenna apparatus of the present preferred embodiment are described below with reference to FIGS. 18 to 20. For example, when no control voltage is applied to the electrical length adjustor circuits 402A, 502A, 602A and 702A connected to the parasitic antenna elements 401A, 501A, 601A and 701A, respectively, the directivity of the monopole antenna element 101B extends in a omnidirectionally in an XY plane of FIG. 17, i.e., a wireless module substrate installation plane. In order to direct the directivity of the monopole antenna element 101 to a −X direction, a voltage is applied to the electrical length adjustor circuits 502A and 602A. Therefore, the parasitic antenna elements 501A and 601A are excited to act as reflectors for the monopole antenna element 101B. With respect to the monopole antenna element 101B, an amplitude of a radio wave in a +X direction is weakened, and an amplitude of a radio wave in the −X direction is enhanced. Therefore, the directivity of the monopole antenna element 101B is directed to the −X direction. In this case, it should be noted that the parasitic antenna element 501A also acts as a reflector for the monopole antenna element 201B to change the directivity of the monopole antenna element 201B to a +Y direction. In addition, the parasitic antenna element 601A changes the directivity of the monopole antenna element 301B to a −Y direction in a manner similar to that of the parasitic antenna element 501A.

In a manner similar to above, it is possible to obtain a combination of directivities in $2^4=16$ ways by changing combination of parasitic antenna elements to be excited (i.e., to be operated as a reflector).

Figure 22:
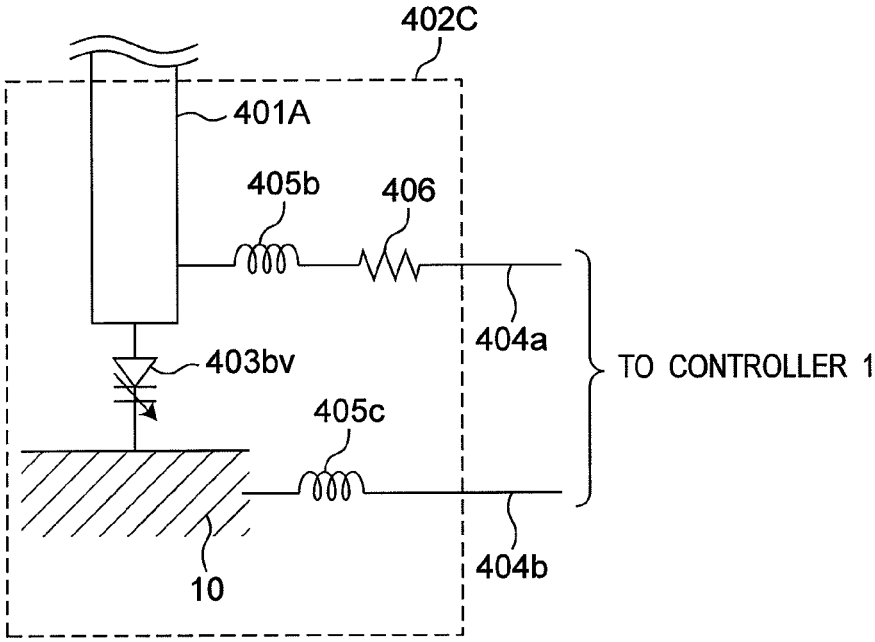
FIG. 22 is an enlarged view of an electrical length adjustor circuit 402C according to a first modified preferred embodiment of the third preferred embodiment of the present invention.

It should be noted that the present preferred embodiment utilizes the conduction and non-conduction of the PIN diode to adjust the electrical length. However, for example, a varicap diode 403*bv* (a varactor diode) may be used for switching the electrical length by changing a reactance value, as shown in FIG. 22. FIG. 22 is an enlarged view of an electrical length adjustor circuit 402C according to a first modified preferred embodiment of the third preferred embodiment of the present invention. The electrical length adjustor circuit 402C is different from the electrical length adjustor circuit 402A in such a point that the varicap diode 403*bv* is provided instead of the PIN diode 403*b*. Referring to FIG. 22, an anode terminal of the varicap diode 403*bv* is connected to the parasitic antenna element 401A, and a cathode terminal of the varicap diode 403*bv* is connected to the ground conductor 10. The anode terminal of the varicap diode 403*bv* is connected to the applied bias voltage terminal DC4 of the controller 1 via the inductor 405*b*, the resistor 406 and the control line 404*a*. Further, the cathode terminal of the varicap diode 403*bv* is connected to the ground terminal GND of the controller 1 via the ground conductor 10, the inductor 405*c* and the control line 404*b*. The controller 1 successively changes a bias voltage to be applied to the varicap diode 403*bv* to change a capacitance value of the varicap diode 403*bv*, and successively changes the electrical length of the parasitic antenna element 401A.

As described above, according to the antenna apparatus of the present preferred embodiment, the parasitic antenna elements 401A, 501A, 601A and 701A are arranged at the positions so as to be capable of simultaneously changing the directional pattern of the feeding element 101B on the first surface of the dielectric substrate 21 and the directional pattern of one of the feeding elements 201B and 301B on the second surface of the dielectric substrate 21. Each of the feeding elements 101B, 201B and 301B is arranged at the position so as to be influenced by one of the parasitic antenna elements 401A and 701A on the first surface and one of the parasitic antenna elements 501A and 601A on the second surface. Concretely speaking, the parasitic antenna element 401A is provided in proximity to the feeding antenna elements 101B and 20113 so as to be electromagnetically coupled to the feeding antenna elements 101B and 201B. The parasitic antenna element 501A is provided in proximity to the feeding antenna elements 101B and 201B so as to be electromagnetically coupled to the feeding antenna elements 101B and 201B. The parasitic antenna element 601A is provided in proximity to the feeding antenna elements 101B and 301B so as to be electromagnetically coupled to the feeding antenna elements 101B and 301B. The parasitic antenna element 701A is provided in proximity to the feeding antenna elements 101B and 301B so as to be electromagnetically coupled to the feeding antenna elements 101B and 301B. Therefore, it is possible to increase and decrease electric power in the normal direction of the dielectric substrate 21, and it is possible to control so as to obtain an optimal combination of the directivities of the respective feeding elements 101B, 201B and 301B. Therefore, it is possible to provide a small-sized antenna apparatus having a directivity switching function suitable for a MIMO communication system.

In addition, the preferred embodiment described above represents the example that the feeding antenna elements 101B, 201B and 301B are configured as monopole antenna elements. However, it is possible to realize an antenna apparatus that operates in a manner similar to that of the present preferred embodiment even in a case of using sleeve antennas, inverted F type antennas or dipole antennas.

Fourth Preferred Embodiment

Figure 24:
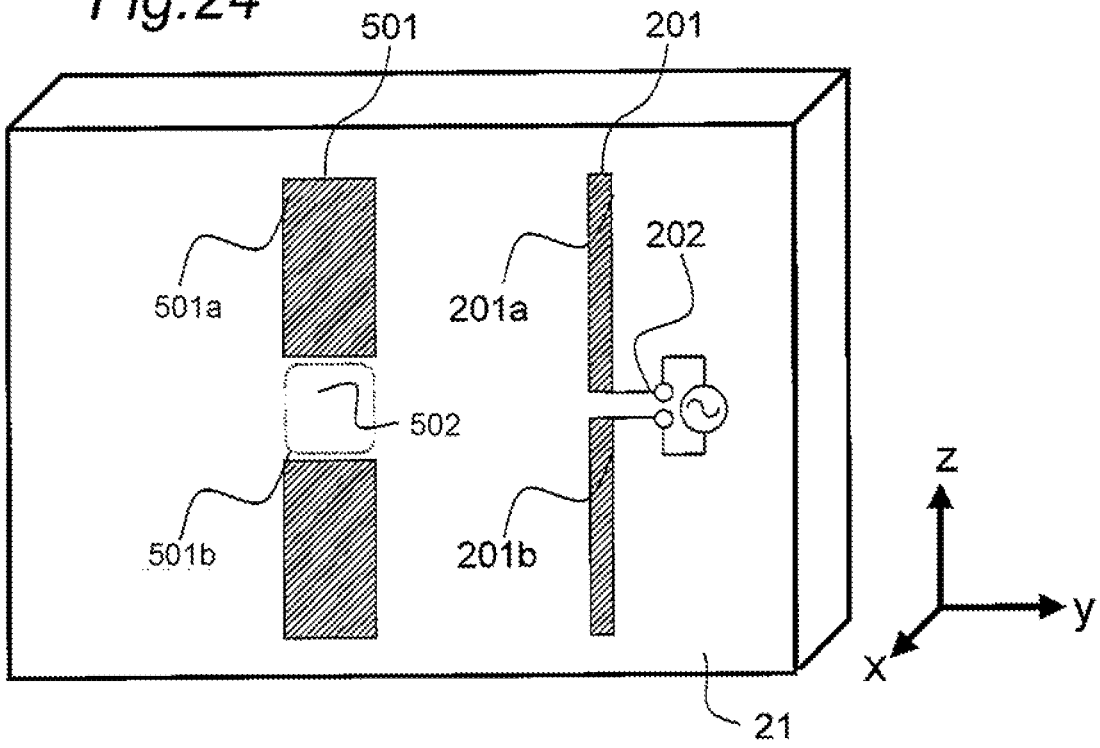
FIG. 24 is a perspective view when an antenna apparatus according to a fourth preferred embodiment of the present invention is seen from a front side thereof.
Figure 25:
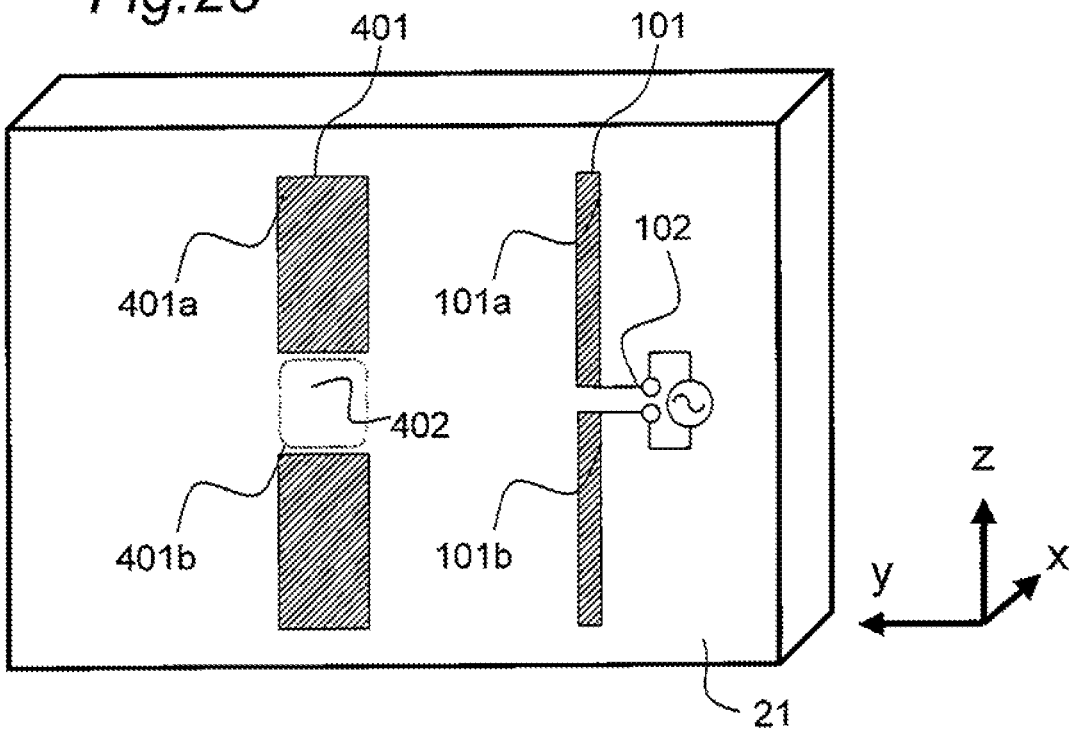
FIG. 25 is a perspective view when the antenna apparatus of FIG. 24 is seen from a back side thereof.
Figure 26:
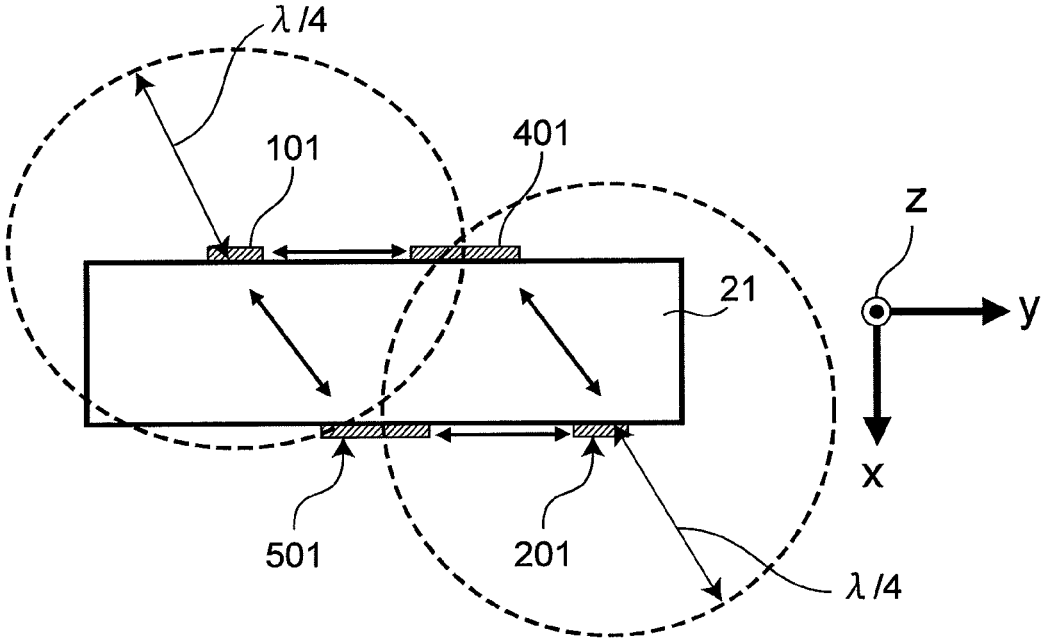
FIG. 26 is a top view of the antenna apparatus of FIGS. 24 and 25.

FIG. 24 is a perspective view when an antenna apparatus according to a fourth preferred embodiment of the present invention is seen from a front side thereof, and FIG. 25 is a perspective view when the antenna apparatus of FIG. 24 is seen from a back side thereof. In addition, FIG. 26 is a top view of the antenna apparatus of FIGS. 24 and 25. As compared with the antenna apparatus according to the first preferred embodiment, the antenna apparatus according to the present preferred embodiment has such a feature that the dipole antenna element 301 and the parasitic antenna elements 601 and 701 are removed.

The parasitic antenna elements 401 and 501 are arranged at two positions including a position away from the dipole antenna element 101 by the distance corresponding to one-fourth of the operating wavelength λ in communication, and a position away from the dipole antenna element 201 by the distance corresponding to one-fourth of the operating wavelength λ in communication. Therefore, the number of shapes of directivity to be taken by the dipole antenna element 101 is $2^2=4$ ways since the number of parasitic antenna elements, which exert an influence on the dipole antenna element 101, is two. In a manner similar to above, the number of shapes of directivity to be taken by the dipole antenna element 201 is four ways. The antenna apparatus according to the present preferred embodiment exhibits effects similar to those of the antenna apparatus according to the first preferred embodiment.

Figure 27:
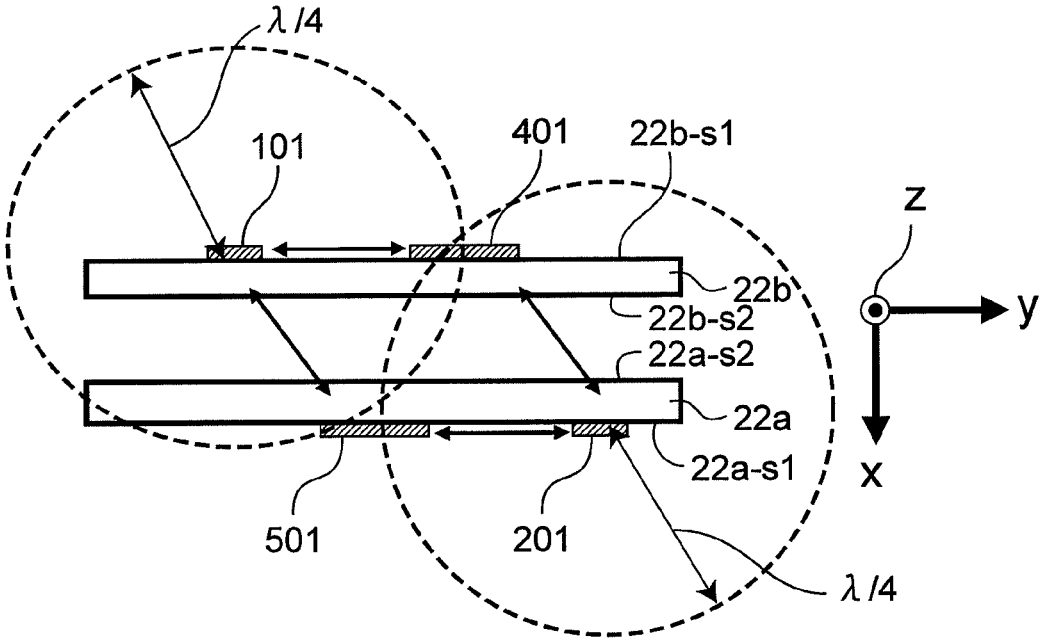
FIG. 27 is a top view of an antenna apparatus according to a first modified preferred embodiment of the fourth preferred embodiment of the present invention.

It should be noted that two printed circuit boards 22*a* and 22*b* may be used instead of the dielectric substrate 21, as shown in FIG. 27. FIG. 27 is a top view of an antenna apparatus according to a first modified preferred embodiment of the fourth preferred embodiment of the present invention. As compared with the antenna apparatus according to the fourth preferred embodiment, the antenna apparatus according to the present modified preferred embodiment has such a feature that the two printed circuit boards 22*a* and 22*b*, which are provided in parallel with each other in a manner similar to those of the second preferred embodiment, are used instead of the dielectric substrate 21. In this case, a distance between the printed circuit boards 22*a* and 22*b* is set so that a gap between dipole antenna elements 101 and 201 and a gap between parasitic antenna elements 401 and 501 are equal to the gaps described above. In addition, the dipole antenna element 101 and the parasitic antenna element 401 are provided on the first surface 22*b*-s1 of the printed circuit board 22*b*, and the dipole antenna element 201 and the parasitic antenna element 501 are provided on the first surface 22*a*-s1 of the printed circuit board 22*a*.

Figure 28:
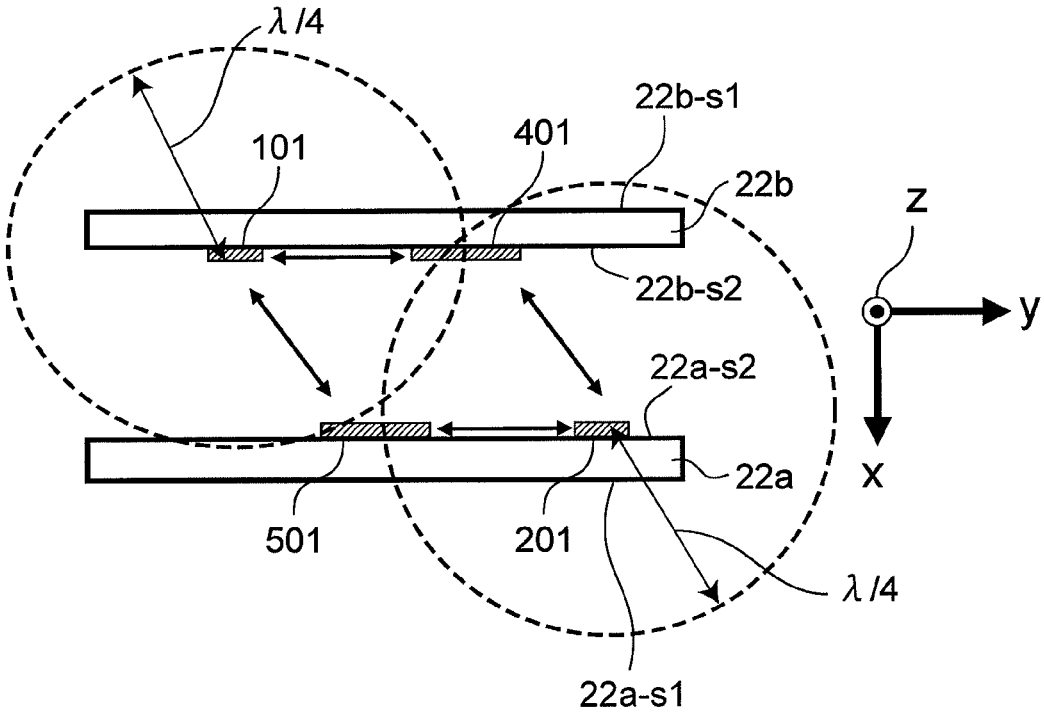
FIG. 28 is a top view of an antenna apparatus according to a second modified preferred embodiment of the fourth preferred embodiment of the present invention.

In addition, as shown in FIG. 28, the dipole antenna element 101 and the parasitic antenna element 401 may be provided on the second surface 22*b*-s2 of the printed circuit board 22*b*, and the dipole antenna 201 and the parasitic antenna element 501 may be provided on the second surface 22*a*-s2 of the printed circuit board 22*a*. FIG. 28 is a top view of an antenna apparatus according to a second modified preferred embodiment of the fourth preferred embodiment of the present invention. In this case, a distance between the printed circuit boards 22*a* and 22*b* is set so that a gap between the dipole antenna elements 101 and 201 and a gap between the parasitic antenna elements 401 and 501 are equal to the gaps described above.

Figure 29:
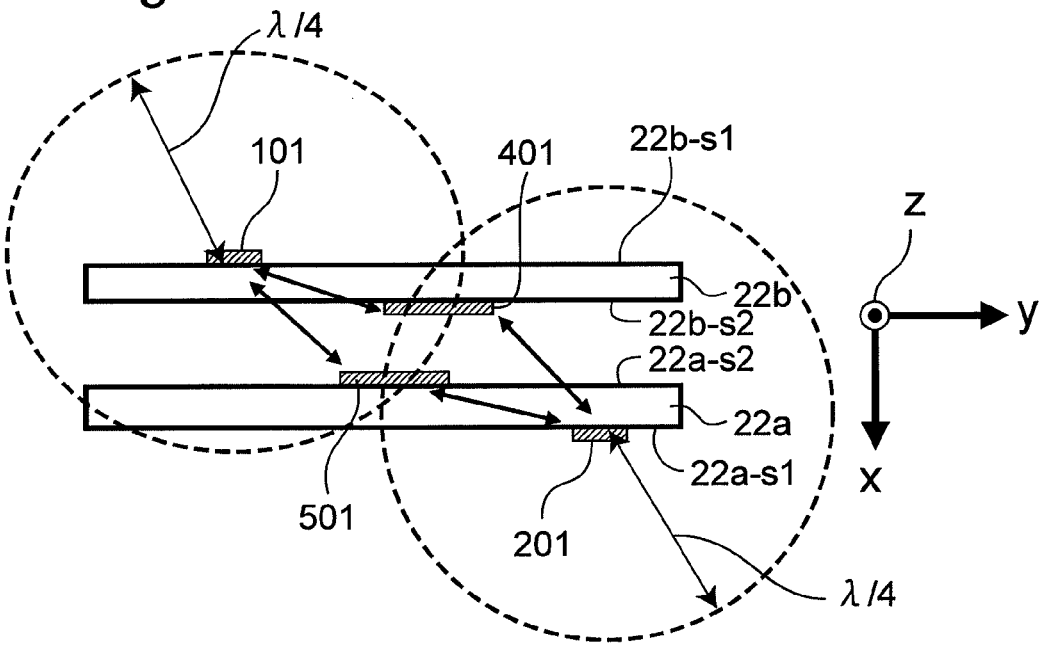
FIG. 29 is a top view of an antenna apparatus according to a third modified preferred embodiment of the fourth preferred embodiment of the present invention.

Further, FIG. 29 is a top view of an antenna apparatus according to a third modified preferred embodiment of the fourth preferred embodiment of the present invention. As shown in FIG. 29, the dipole antenna element 101 may be provided on the first surface 22*b*-s1 of the printed circuit board 22*b*, the parasitic antenna element 401 may be provided on the second surface 22*b*-s2 of the printed circuit board 22*b*, the dipole antenna 201 may be provided on the first surface 22*a*-s1 of the printed circuit board 22*a*, and the parasitic antenna element 501 may be provided on the second surface 22*a*-s2 of the printed circuit board 22*a*.

Figure 30:
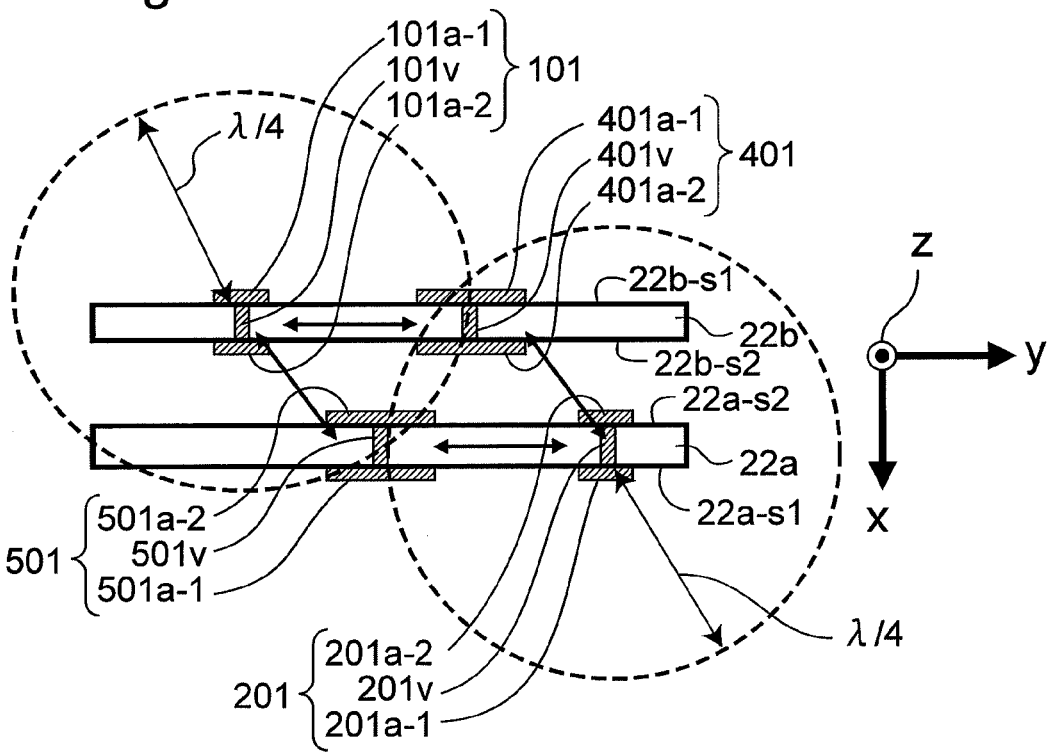
FIG. 30 is a top view of an antenna apparatus according to a fourth modified preferred embodiment of the fourth preferred embodiment of the present invention.

Still further, FIG. 30 is a top view of an antenna apparatus according to a fourth modified preferred embodiment of the fourth preferred embodiment of the present invention. Referring to FIG. 30, the dipole antenna element 101 and the parasitic antenna element 401 are formed on the two surfaces of the printed circuit board 22*b*, respectively, and the dipole antenna 102 and the parasitic antenna element 501 are formed on the two surfaces of the printed circuit board 22*a*, respectively. Concretely speaking, the feeding conductor element 101*a* (See FIG. 25) of the dipole antenna element 101 includes a feeding conductor element 101*a*-1 and a feeding conductor element 101*a*-2 formed on the first surface 22*b*-s1 and the second surface 22*b*-s2 of the printed circuit board 22*b*, respectively, and a via conductor 101*v* for electrically connecting between the feeding conductor elements 101*a*-1 and 101*a*-2. In addition, the parasitic conductor element 401*a* (See FIG. 25) of the parasitic antenna element 401 includes a parasitic conductor element 401*a*-1 and a parasitic conductor element 401*a*-2 formed on the first surface 22*b*-s1 and the second surface 22*b*-s2 of the printed circuit board 22*b*, respectively, and a via conductor 401*v* for electrically connecting between the parasitic conductor elements 401*a*-1 and 401*a*-2. Further, the feeding conductor element 201*a* (See FIG. 24) of the dipole antenna element 201 includes a feeding conductor element 201*a*-1 and a feeding conductor element 201*a*-2 formed on the first surface 22*a*-s1 and the second surface 22*a*-s2 of the printed circuit board 22*a*, respectively, and a via conductor 201*v* for electrically connecting between the feeding conductor elements 201*a*-1 and 201*a*-2. In addition, the parasitic conductor element 501*a* (See FIG. 24) of the parasitic antenna element 501 includes the parasitic conductor element 501*a*-1 and the parasitic conductor element 501*a*-2 formed on the first surface 22*a*-s1 and the second surface 22*a*-s2 of the printed circuit board 22*a*, respectively, and a via conductor 501*v* for electrically connecting between the parasitic conductor elements 501*a*-1 and 501*a*-2.

Namely, the two printed circuit boards 22*a* and 22*b* may be used in a manner similar to that of the second preferred embodiment and the respective modified preferred embodiments of the fourth preferred embodiment. Alternatively, the integrated dielectric substrate 21 may be used in a manner similar to that of the first preferred embodiment, the modified preferred embodiments of the first preferred embodiment, the third preferred embodiment, and the fourth preferred embodiment. In addition, in the case of using the two printed circuit boards 22*a* and 22*b*, it is advisable that the feeding antenna element 201 is provided on at least one of the first surface 22*a*-s1 and the second surface 22*a*-s2 of the printed circuit board 22*a*, the parasitic antenna element 501 is provided on at least one of the first surface 22*a*-s1 and the second surface 22*a*-s2 of the printed circuit board 22*a*, the feeding antenna element 101 is provided on at least one of the first surface 22*b*-s1 and the second surface 22*b*-s2 of the printed circuit board 22*b*, and the parasitic antenna element 401 is provided on at least one of the first surface 22*b*-s1 and the second surface 22*b*-s2 of the printed circuit board 22*b*. Further, it is advisable that at least one feeding antenna element 101 (corresponding to a first feeding element), at least one feeding antenna element 201 (corresponding to a second feeding element), at least one parasitic antenna element 401 (corresponding to a first parasitic element) and at least one parasitic antenna element 501 (corresponding to a second parasitic element) are provided in proximity to one another so that the first parasitic element is electromagnetically coupled to the first and second feeding elements and the second parasitic element is electromagnetically coupled to the first and second feeding elements.

In the present preferred embodiment, the sleeve antenna element 101A of FIG. 10 or the monopole antenna element 101B of FIG. 18 may be used instead of the dipole antenna elements 101 and 201. In addition, the parasitic antenna element 401, which is a dipole element, of FIG. 18 may be used instead of the parasitic antenna elements 401 and 501 which are a monopole element. In this case, the electrical length adjustor circuit 402A of FIG. 21 or the electrical length adjustor circuit 402C of FIG. 22 is used instead of the electrical length adjustor circuit 402.

INDUSTRIAL APPLICABILITY

As described above in detail, according to the antenna apparatus of the present invention, an electrical length switch circuit for switching over between activation and non-activation of a parasitic element as a reflector is connected to each of the first parasitic element provided on the first dielectric substrate and the second parasitic element provided on the second dielectric substrate as the controller means. Each of the electrical length switch circuits is configured to use a PIN diode or a variable reactance element. When an appropriate voltage is applied to the electrical length switch circuit, the parasitic element connected to the electrical length switch circuit operates as a reflector. In this case, the first parasitic element is provided in proximity to the first and second feeding elements so as to be electromagnetically coupled to the first and second feeding elements, and the second parasitic element is provided in proximity to the first and second feeding elements so as to be electromagnetically coupled to the first and second feeding elements. Therefore, when one parasitic element is activated as a reflector, main radiation directions of the first and second feeding elements change.

The antenna apparatus according to the present invention can realize various combinations directional patterns with a simple configuration, and therefore, it is useful as a method for arranging a plurality of variable directional antennas in proximity to each other.

REFERENCE SIGNS LIST

1 . . . Controller
10 . . . Ground conductor,
21 . . . Dielectric substrate,
22*a* and 22*b* . . . Printed circuit board,
23 . . . Metal housing,
24 . . . Plastic window,
25 . . . Wireless module substrate,
26-1, 26-2, and 26-3 . . . Signal input and output terminal,
27-1, 27-2, and 27-3 . . . High-frequency coaxial cable,
28 . . . Feeder part,
101, 201, 301, 901, and 1001 . . . Dipole antenna element,
101A, 201A, and 301A . . . Sleeve antenna element,
101B, 201B, and 301B . . . Monopole antenna element,
401, 501, 601, 701, 801, 401A, 501A, 601A, and 701A . . . Parasitic antenna element,
102, 202, and 302 . . . Feeding point,
402, 502, 602, 702, 402A, 402B, 402C, 502A, 602A, and 702A . . . Electrical length adjustor circuit,
101*a*, 101*b*, 201*a*, 201*b*, 301*a*, and 301*b* . . . Antenna conductor element,
401*a*, 401*b*, 501*a*, 501*b*, 601*a*, 601*b*, 701*a*, and 701*b* . . . Parasitic conductor element,
403*a* and 403*b* . . . PIN diode,
403*av* and 403*bv* Varicap diode,
404*a* and 404*b* . . . Control line,
405*a* and 405*b* . . . Inductor,
406 . . . Resistor, and
C101, C201, and C301 . . . Connector.

The invention claimed is:

1. An antenna apparatus comprising:

a first dielectric substrate having first and second surfaces which are in parallel with each other;

a second dielectric substrate having first and second surfaces which are in parallel with each other;

a first feeding element provided on the first surface of the first dielectric substrate; the first feeding element transmitting and receiving a wireless signal;

a first parasitic element provided on the first surface of the first dielectric substrate;

a second feeding element provided on the first surface of the second dielectric substrate, the second feeding element transmitting and receiving a wireless signal;

a second parasitic element provided on the first surface of the second dielectric substrate; and a controller for switching over between activation and non-activation of each of the first and second parasitic elements as a reflector, wherein the first parasitic element is provided in proximity to the first and second feeding elements so as to be electromagnetically coupled to the first and second feeding elements, wherein the second parasitic element is provided in proximity to the first and second feeding elements so as to be electromagnetically coupled to the first and second feeding elements, and wherein the first and second dielectric substrates are formed in an integrated dielectric substrate so that the second surface of the first dielectric substrate and the second surface of the second dielectric substrate are opposed to each other.

2. The antenna apparatus of claim 1, wherein each of the first and second parasitic elements is a dipole element comprising two parasitic conductor elements each having an electrical length of a quarter-wavelength, the two parasitic conductor elements being provided on a straight line, and wherein the controller comprises:

a PIN diode connected in series between the two parasitic conductor elements of the first parasitic element; and a PIN diode connected in series between the two parasitic conductor elements of the second parasitic element.

3. The antenna apparatus of claim 1, wherein each of the first and second parasitic elements is a dipole element comprising two parasitic conductor elements each having an electrical length of a quarter-wavelength, the two parasitic conductor elements being provided on a straight line, and wherein the controller comprises:

a varactor diode connected in series between the two parasitic conductor elements of the first parasitic element; and a varactor diode connected in series between the two parasitic conductor elements of the second parasitic element.

4. The antenna apparatus of claim 1, wherein each of the first and second parasitic elements is a monopole element comprising one parasitic conductor element, which has an electrical length of a quarter-wavelength and is provided vertically with respect to a ground conductor, and wherein the controller comprises:

a PIN diode connected between the parasitic conductor element of the first parasitic element and the ground conductor; and a PIN diode connected between the parasitic conductor element of the second parasitic element and the ground conductor.

5. The antenna apparatus of claim 1, wherein each of the first and second parasitic elements is a monopole element comprising one parasitic conductor element, which has an electrical length of a quarter-wavelength and is provided vertically with respect to a ground conductor, and wherein the controller comprises:

a varactor diode connected between the parasitic conductor element of the first parasitic element and the ground conductor; and a varactor diode connected between the parasitic conductor element of the second parasitic element and the ground conductor.

6. The antenna apparatus of claim 1, wherein each of the first and second feeding elements is a dipole antenna.

7. The antenna apparatus of claim 1, wherein each of the first and second feeding elements is a sleeve antenna.

8. The antenna apparatus of claim 1, wherein each of the first and second feeding elements is a monopole antenna.

9. The antenna apparatus of claim 1, wherein the first parasitic element is provided to be away from the first and second feeding elements by a distance of a quarter-wavelength, and wherein the second parasitic element is provided to be away from the first and second feeding elements by the distance corresponding to the quarter-wavelength.

10. The antenna apparatus of claim 1, comprising:

a third parasitic element provided on the first surface of the second dielectric substrate;

a third feeding element provided on the first surface of the second dielectric substrate; and a fourth parasitic element provided on the first surface of the first dielectric substrate.

* * * * *